United States Patent [19]

Takanashi et al.

[11] Patent Number: 4,917,513

[45] Date of Patent: Apr. 17, 1990

[54] THERMAL IMPRINT RECORDING APPARATUS

[75] Inventors: Itsuo Takanashi, Kamakuro; Hideshi Tanaka, Yokohama; Shigeru Kato, Yokohama; Naomi Osada, Yokohama; Toshikatsu Ichito, Kawasaki, all of Japan

[73] Assignee: Victor Company of Japan, Kanagawa, Japan

[21] Appl. No.: 267,534

[22] Filed: Nov. 4, 1988

[30] Foreign Application Priority Data

Nov. 6, 1987 [JP] Japan ..... 62-280794
Mar. 9, 1988 [JP] Japan ..... 63-31345[U]

[51] Int. Cl.[4] ..... B41J 3/02

[52] U.S. Cl. ..... 400/120; 400/208; 400/703; 400/595; 400/613

[58] Field of Search ..... 101/120, 194, 196, 207, 101/208, 208.1, 223, 247, 595, 602, 613, 613.2, 624, 629, 618, 703, 648

[56] References Cited

U.S. PATENT DOCUMENTS

| | | | |
|---|---|---|---|
| 4,632,585 | 12/1986 | Oyamatsu et al. | 400/613 |
| 4,696,590 | 9/1987 | Bierhoff et al. | 400/613 |
| 4,698,646 | 10/1987 | Satoh et al. | 400/613 |
| 4,700,791 | 10/1987 | Iwasaki et al. | 400/613 |
| 4,712,933 | 12/1987 | Natsume | 400/208 |
| 4,754,290 | 6/1988 | Kitayama et al. | 400/207 |
| 4,764,041 | 8/1988 | Bierhoff | 400/618 |
| 4,832,576 | 5/1989 | Basile | 400/120 |
| 4,836,697 | 6/1989 | Plutnick et al. | 400/120 |

*Primary Examiner*—Eugene H. Eickholt
*Attorney, Agent, or Firm*—Michael N. Meller

[57] ABSTRACT

A thermal imprint recording apparatus for recording an image on a paper by a thermal head uses a cartridge of recording paper on which a roll of ink film for supplying the ink film and another roll on which the ink film is taken up are carried. The apparatus comprises an arm adapted to engage with one of the rolls when the cartridge is loaded on the apparatus. Responsive to the loading, the arm is swung upwards and the roll is lifted from the cartriddge. The roll is then carried over a platen roller of the printer and the ink film is drawn out so as to engage with the upper surface of the platen roller. Further, the paper is taken out from the bottom of the cartridge and is transported along a path passing below the platen roller to a predetermined printing station located between the platen roller and the ink film. As a result, the path for feeding the paper on the platen roller becomes short and the circuitous path for supplying the paper to the platen roller around the rolls of ink film and a thermal head is eliminated and thus the apparatus can be constructed compactly.

6 Claims, 20 Drawing Sheets

30
top
bottom
front
W
IIc
IIc 260
280
269b(269a)
282
253
281
277
278
E1
E2
276
58
51
31b
31
274
275
273
31a 260
280
274
282
32
275
281
268b
33a
33
E1
E2
51
31
273
35
34
273
271
31a
280
274
282
281
275
268a
268
50
272

260
260
280
32
282
269b(69a)
33
269
276
E2
31b
31
51
274
275
283b1
268b
268b
283
268
31a
21
280
274
283b2
269b
33a
275
54b
54
35
34
32
268
273
273
271
53b
53
31
280
274
282
283a2
269a
275
283a1
268a
283
33
50
50a

THERMAL IMPRINT RECORDING APPARATUS

BACKGROUND OF THE INVENTION

The present invention relates to a thermal imprint recording apparatus, and particularly relates to a thermal imprint recording apparatus for recording information by pressing a thermal head on a recording paper via an ink film.

Recently, thermal imprint type recording apparatus (printer) have been widely used for printing an image of computer graphics and the like because of simplicity of the mechanism, high recording speed, and ease of handling.

A typical thermal imprint recording apparatus records predetermined information or a predetermined image on the recording paper by pressing a thermal head assembly on the recording paper via an ink tape or film carrying ink thereon, with the recording paper being placed on a platen roller which is rotated by a DC motor, pulse motor and the like. The thermal head assembly is constructed by a group of thermal elements arranged in a row along the longitudinal direction of the platen roller as well as in the lateral direction of the recording paper. Such a linearly configured thermal head system appropriately controls current supplied to each of the thermal elements and prints a single line portion of the information at a time. Thereafter, the platen roller is rotated and the recording of the subsequent line is performed. By repeating this sequence, colour image information such as a predetermined script or picture is recorded in a sequence of lines on the recording paper. The ink film may be constructed such that coloured ink of three primary colours, yellow (Y), magenta (M), and cyan (C) are deposited with a predetermined form on a base film. According to the needs, a fourth colour of black (a) may be included. When using such an ink film for the imprint recording, the imprint recording is performed by mechanically setting a predetermined positional relationship between a first colour ink part on the ink film and the recording paper, and then bringing the two into contact with one another and performing the imprint recording. After the first colour of the ink has been printed, the ink film is fed so as to set a predetermined positional relationship between a second colour ink part on the ink film and the recording paper which is maintained stand still, and then bringing the two into contact with one another and performing the imprint recording. Thereafter, by repeating the operation as described above for the remaining colours of the ink on the ink film, the desired colour printing is completed.

Each time the thermal imprint recording apparatus performs the imprint recording, the ink of the ink film is consumed. For the consumption of the ink film and the recording paper, a roll of or stack of such consuming materials is prepared as a first supply, but these still needs a replacement of the supply after a consumption thereof.

In order to smoothly perform the replacement of the supply, cartridges such as a ink film cartridge accommodating the ink film, and a recording paper cartridge accommodating the recording paper are widely used at present. However, the operation of the apparatus which uses these cartridges is cumbersome because it is necessary to load two different cartridges into separate locations on the apparatus, thus taking up considerable space.

Accordingly, a unitary type cartridge has been proposed in which an ink film housing and a recording paper housing are unitarily constructed. That is, the unitary type cartridge is made so as to allow simultaneous checking of the consumption of the recording paper and the ink film at the time the ink film is replaced or the recording paper is supplied. Thus, one can avoid an inconvenience such that the recording paper or the ink film is not available at hand, by previously providing these materials whenever it becomes clear that one or both of these materials are short in the cartridge. As a result, one can supply the recording paper or change the ink film beforehand.

However, such a unitary type cartridge has problems as will be described hereinafter. Generally, when loading the cartridge having such a unitary construction of an ink film housing part and a paper housing part on the thermal imprint recording apparatus, the ink film has to be drawn out from the cartridge so as to pass over the platen roller. This operation has to be done by the thermal imprint recording apparatus and the loading operation of the apparatus becomes complex. As a result, there is a tendency that the loading operation of the ink film becomes unreliable and the reliability of the thermal imprint recording apparatus is decreased. Further, in such a case that the cartridge is loaded into the apparatus at an incorrect angle of loading with respect to the apparatus, damage such as creasing may occur on the ink film when the apparatus attempts to draw out the ink film and thus problems such as the inability to perform a satisfactory imprint recording due to non-uniform loading of the ink film occur.

Further, there is another conventional thermal imprint recording apparatus as proposed for example in a Japanese Laid Open Utility Model Application No. 977653/1987. In this apparatus, the ink film is drawn out in an upward direction from the cartridge and is passed over an upper surface of the platen roller while the recording paper is supplied also from an upper surface of the cartridge and is transported along a path extending above the platen roller. In this apparatus, however, it is necessary that the recording paper is supplied in between the platen roller and the ink film. As the ink film is passed over the platen roller as already described, the recording paper has to be supplied through a circuitous path extending from the upper surface of the cartridge, passing above the ink film, going around a ink film draw-out means, and reaching a position between the ink film and the platen roller. In this manner, the path traced by the supply of the recording paper forms a large loop, and on account of this, there is a problem that the conventional thermal imprint recording apparatus inevitably becomes large in order to accommodate the supply path of the recording paper.

SUMMARY OF THE INVENTION

Accordingly, it is a general object of the present invention to provide a novel and useful thermal imprint recording apparatus in which the problems described heretofore are eliminated.

Another and more specific object of the present invention is to provide a thermal imprint recording apparatus which uses a cartridge adapted to carry a roll of ink film and a stack of recording papers, said cartridge being constructed such that an ink film is drawn out from a first side of the cartridge which is opposite to a second side of the cartridge from which recording paper is fed. The thermal imprint recording apparatus comprises a recording paper feeding means disposed so as to locate at said first side of the cartridge for feeding the recording paper, a loading means disposed at said second side of the cartridge for drawing out the ink film from the roll within the cartridge, and a recording paper discharge means disposed on the same side as the recording paper feeding means relative to the cartridge for discharging the recording paper to the exterior of the apparatus. According to the present invention, the recording paper feeding means can be constructed compactly, and the overall size of the thermal imprint recording apparatus can also be constructed compactly.

Other objects and further features of the present invention will become apparent from the following detailed description when read in conjunction with the accompanying drawings.

BRIEF DESCRIPTION OF THE DRAWINGS

FIG. 11 is a perspective view showing an embodiment of thermal imprint recording apparatus according to the present invention in an exploded state;

DETAILED DESCRIPTION

Figure 1:
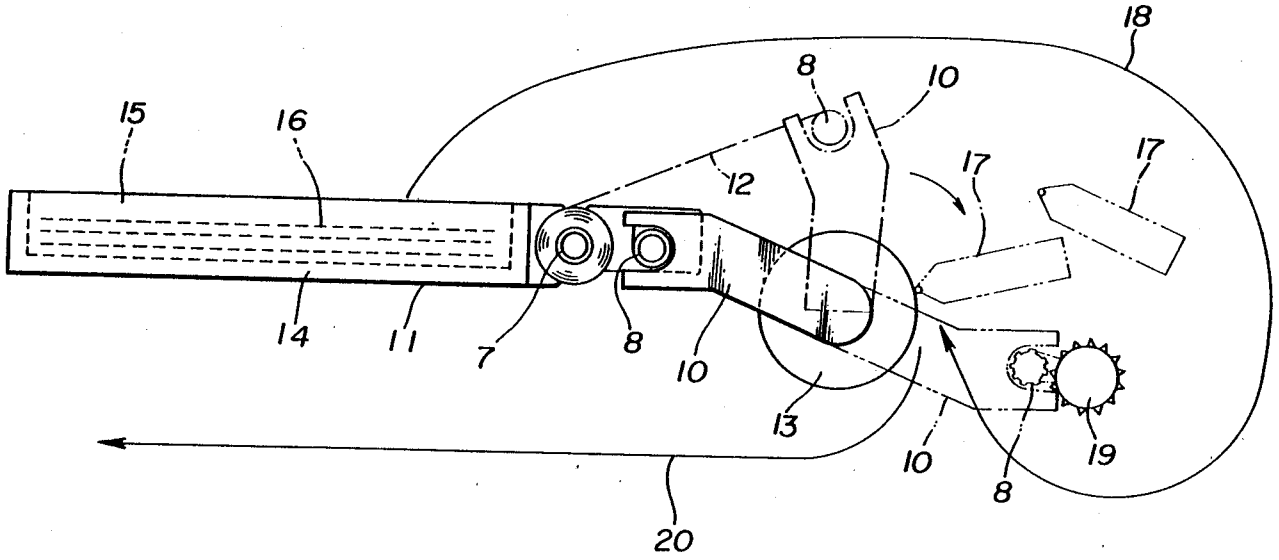
FIG. 1 (PRIOR ART)
FIG. 1 is a view showing possible paths for supplying and discharging a recording paper in a prior art thermal imprint recording apparatus.

FIG. 1 shows a prior art thermal imprint recording apparatus (hereinafter referred to as printer) disclosed in the Japanese Laid-open Utility Model Application No. 97765/1987. Referring to the drawing, the printer uses a cartridge 11 comprising a recording paper accommodating part 14 in which a stack of recording papers 16 are accommodated, and a roll holding part adapted to hold a supply roll 7 of an ink film 12 carrying a thermally melting ink thereon. The printer on the other hand comprises a platen roller 13 on which the recording paper 16 is fed from the recording paper accommodating part 14 of the cartridge 11 along a supply path 18, and the recording is made by pressing a thermal head 17 on the recording paper 16 via the ink film 12 which in turn is fed from the supply roll 7 on the cartridge 11. The ink film 12 is taken up by a take up reel 8 held rotatably on a swing lever 10. The swing lever 10 is held rotatably on an axis coincident to the axis of the platen roller 13. Thus, when feeding the ink film 12 from the supply roll 7, the lever 10 carrying the take up roll 8 is swung in the clockwise direction about its axis and the ink film 12 is drawn out along an upper side of the platen roller 13. Thus, the paper 16 fed along the path 18 is held between the platen roller 13 and the ink film 12, and the printing is made by the thermal head 17 which selectively applies heat to the ink film 12 held on the paper 16 on the platen roller 13. When the printing is completed, the platen roller 13 is rotated in a reversed direction and the paper 16 is discharged along a path 20.

In this prior art printer, the recording paper accommodating part 14 of the cartridge 11 has an opening 15 formed on its upper surface, and the recording paper 16 is loaded within the recording paper accommodating part 14 through this opening 15. At the time of printing, the recording paper 16 is fed from the opening 15 and is transported around the circuitous path 18 running around the thermal head 17 and a take-up gear 19 provided to drive the take up roll of the ink film. It should be noted that this circuitous path 18 becomes inevitably large as there is no way of bringing the paper 16 directly to the platen roller 13 across the path of the ink film 12. Therefore, there is a problem that the printer which performs the above described operation is large in size and has a complicated construction.

Figures 2A, 2B, 2C:
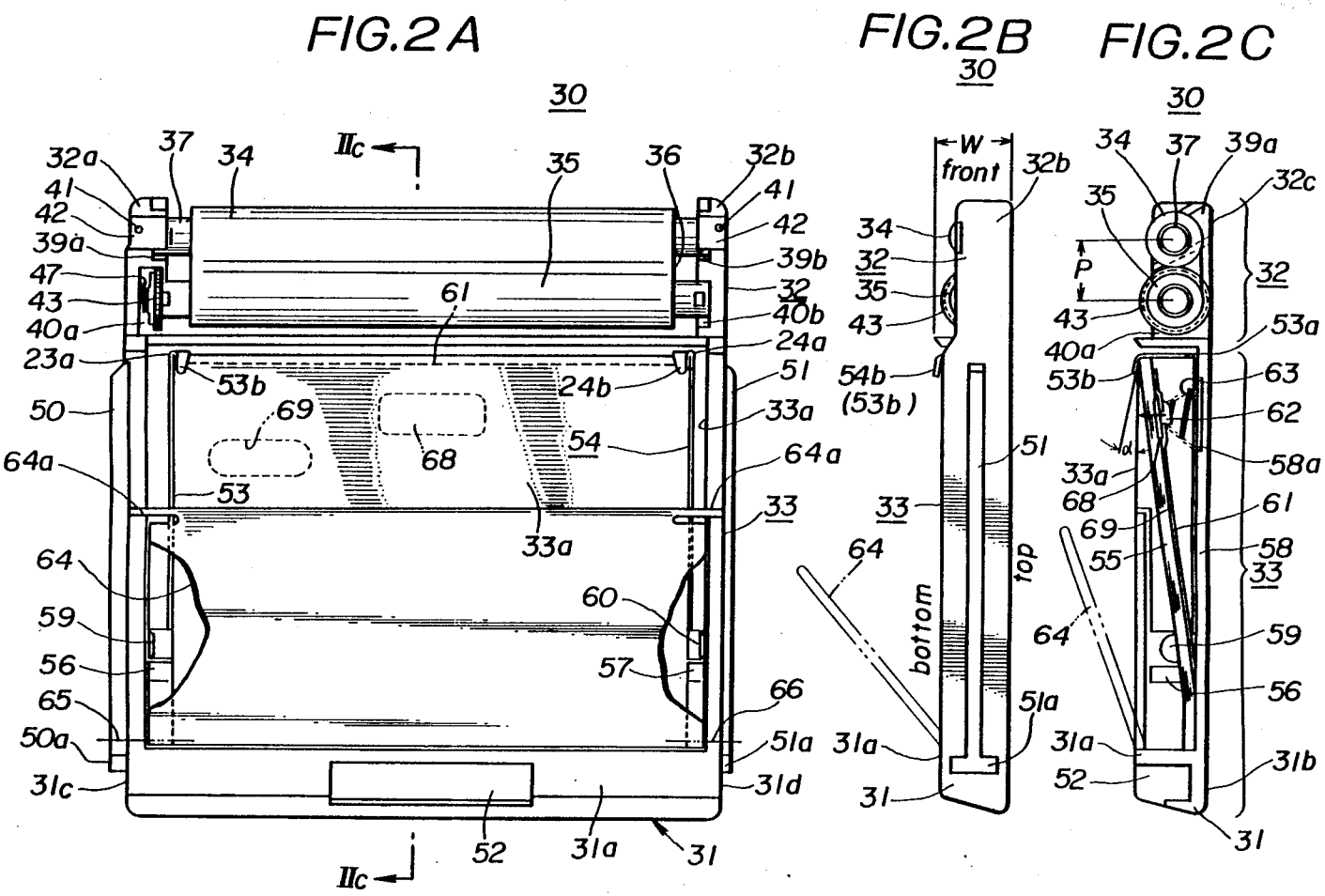
FIGS. 2(A) through (C) are respectively a bottom view, a right side view, and a sectional view along a line $II_C$—$II_C$ showing a cartridge used in the thermal imprint recording apparatus of the present invention.
Figure 3:
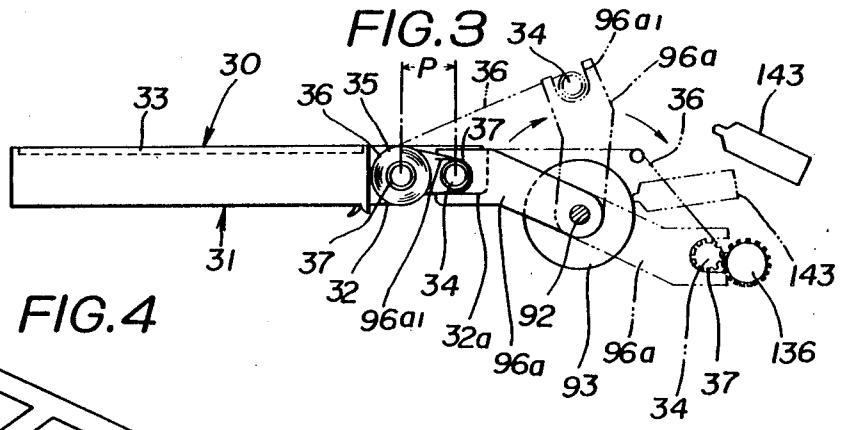
FIG. 3 is a schematical view showing a relationship between the thermal imprint recording apparatus and the cartridge shown in FIG. 2(A)

FIGS. 2(A) through (C) show a preferred embodiment of the cartridge applicable to the printer of the present invention in which FIG. 2(A) is a bottom view, FIG. 2(B) is a side view showing the cartridge of FIG. 2(A) seen from the right, and FIG. 2(C) is a sectional view taken along a line $II_C$—$II_C$ in FIG. 2(A). Further, FIG. 3 is a schematical diagram showing a fundamental relationship between the printer and the cartridge of the present invention.

Referring to FIGS. 2(A) through (C) and FIG. 3, a cartridge 30 comprises a cartridge body 31 on which an ink roll holding part 32 is provided at its front end. In this part 32, a supply roll 35 for supplying the ink film 36 and a take-up roll 34 for taking up the ink film 36 are held rotatably. Further, a recording paper accommodating part 33 is provided on the cartridge body 31 at its rear part away from the ink roll holding part 32.

The cartridge 30 is loaded into a printer to be described later in a horizontal state such that the end of the cartridge body 31 carrying the ink roll holding part 32 is loaded first into the printer. Further, the cartridge 30 is loaded in such a direction that the recording paper is supplied out in a downward direction from the bottom of the cartridge 30. Thereafter, as shown in FIG. 3, arms **96*a* and 96*b* held rotatably of a shaft 92 on which a platen roller 93 is also held and carrying the take up roll 34 thereon is rotated in a clockwise direction so as to move the take up roll 34 away from the recording paper housing while maintaining a state in which the take-up roll 34 is engaged with U-shaped cutout portions $96a_1$ and $96b_1$ of the arms 96*a* and 96*b*. Thus, the take-up roll 34 is moved out of the cartridge 30 passing through a first opening 32*c* shown in FIG. 2C and is separated from the cartridge 30. As a result of the movement of the arms 96*a* and 96*b*, the ink film 36 is thus passed over the platen roller 93. When the arms 96*a* and 96*b* are fully moved in the clockwise direction, the take-up roll 34 is engaged with a take-up driving mechanism comprising gears 136 and 137 in the printer and is thus rotated by the take-up driving mechanism. Thus, the ink film is further taken up on the take-up roll 34 responsive to the rotation of the gears 136 and 137**.

A description will now be given on the details of the construction of the cartridge 30 with reference to FIGS. 2(A) through (C). The ink roll holding part 32 of the cartridge body 31 has a substantially U-shaped frame portion such that a pair of arms **32*a* and 32*b* constitute the U-shaped portion and the arms extend toward a front end of the cartridge body 31. The paper accommodating part 33 is constructed to have a generally rectangular shape and is provided adjacent to the ink roll holding part 32. Further, the recording paper accommodating part 33 has an opening 33*a* provided at a lower portion thereof so as to enable supply of the recording paper from a bottom surface 31*a* of the cartridge body 31. Further, a pair of ribs 50 and 51 are formed along respective side surfaces 31*c* and 31*d* of the cartridge body 31, and these ribs act as a guide member at the time of insertion of the cartridge 30 into the printer. Further, the ribs 50 and 51 are provided at different heights with respect to one another on the respective side surfaces 31*c* and 31*d* in order to prevent erroneous insertion such that the insertion of the cartridge reversed into the printer is positively prevented. Thus when the cartridge 30 is correctly loaded at a proper angle of insertion into the printer, the ribs 50 and 51 are correctly engaged with respective grooves provided in the printer and thus the inserting operation is permitted. Further, T-shaped stoppers 50*a* and 51*a* are respectively provided at the end of the ribs 50 and 51 close to the rear end of the cartridge 30. Thus, by contacting with respective tip ends of the grooves, the stoppers 50*a* and 51*a* determine the position of the cartridge 30 to the printer in which the cartridge is fully inserted. At this state, the rear end of the cartridge 30** is substantially flush with the front panel of the printer.

As already described, the take-up roll 34 and the supply roll 35 wound with the ink film 36 are rotatably held between the arms **32*a* and 32*b* with a predetermined separation from one another. In the description hereinafter, the distance between respective rotational axes of the take-up roll 34 and supply roll 35** is designated as P, and the distance P is selected as small as possible provided that the ink film wound on each of the cores do not touch one another.

Figure 4:
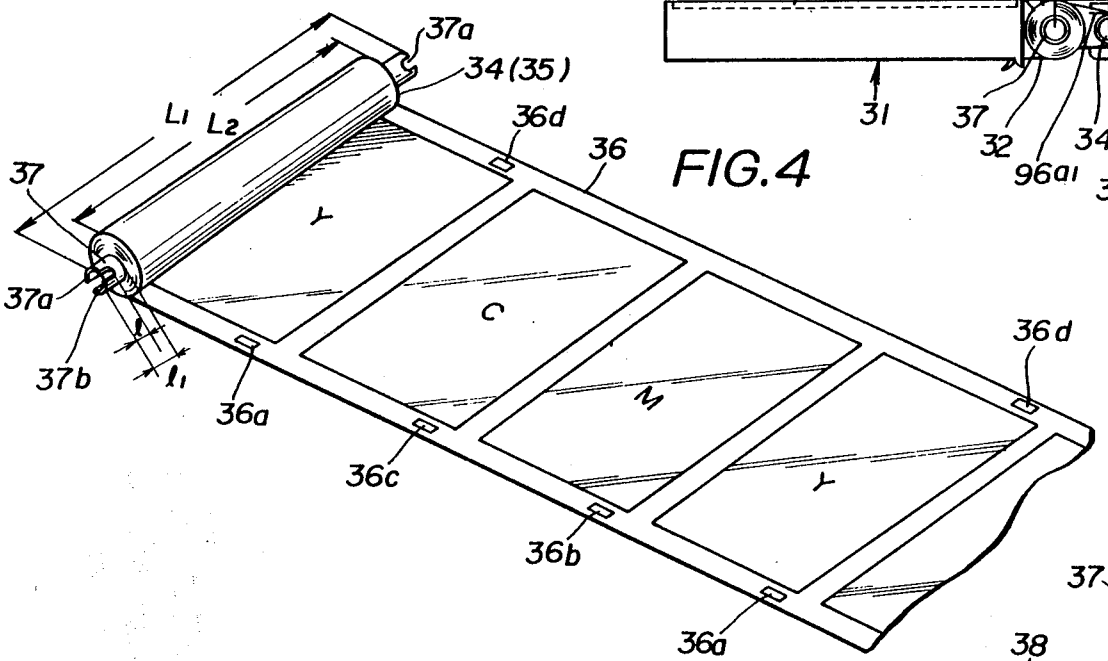
FIG. 4 is a perspective view of a roll of ink film wrapped around a core.

The take-up roll 34 is mounted from a top of the cartridge body 31 whereas the supply roll 35 is mounted from a bottom of the cartridge body 31. Such a construction is used in correspondence with the construction of the cartridge 30 such that the take-up roll 34 is drawn out from a top side **31*b* (FIG. 2(C)) of the cartridge body 31 which in turn is inserted into the printer with the recording paper to be fed out from a bottom side 31*a* (FIG. 2(C)). As shown in FIG. 4, the take-up roll 34 (or the supply roll 35) has the ink film 36 wound on a core 37 of a predetermined length L1 formed from a hollow cylinder made of metal, plastic and the like. The ink film 36 comprises a polyester film base of a width L2 less than the length L1 and on which different colours of a thermal melting type ink or a thermal sublimation type ink are sequentially painted with a predetermined pattern. Typically, colours of yellow (Y), magenta (M), cyan (C), and black (B) as an option are used for color printing. Further, the take-up roll 34 carries the ink film 36 wound thereon such that the ink surface faces inwards. By doing so, deposition of dust, fingerprints, and the like on the ink surface of the ink film 36** is prevented.

On the film 36, black marks **36*a*, 36*b*, and 36*c* are formed in a longitudinal direction along one side portion of the ink film 36 in order to show initial positions at which the formation or pattern of the ink of the respective colours of Y, M, and C commence. Further, a black mark 36*d* is formed in the longitudinal direction along another side of the film 36** in order to show an initial position at which the formation of the ink of the first colour Y commences.

On both ends of the core 37, a pair of slits **37*a* of a predetermined depth l set so as to satisfy a relation $(L1-L2)/2>l$ and having a substantial V-shape diverging outwards is formed. By choosing the length l as such, a margin $l_1$ is formed at both the sides of the core 37 and it becomes possible to engage with arms 96*a* and 96*b* of the printer in this part. In this construction, neither end of the ink film 36 is wound onto the region of the grooves 37*a*, and the ink film 36 is wound uniformly onto the core 37 without occurrence of creases thereon. Thus it is possible to stably and reliably perform printing with high quality and gradation without causing damage to the ink film 36. As will be described later, the presence of the grooves 37***a* on the core 37 in the take-up side enables a smooth coupling with respective coupling portions 139 of the printer as shown in FIG. 11, and the presence of the grooves 37*a* in the supply side takes up the slackening of the ink film at the time the cartridge is ejected from the printer. Further, an internal circumferential portion at both ends of the core 37 has a predetermined rounded edge portion 37*b* in order for secure centering of the core 37 of the take up side when mounted in the cartridge 30 as illustrated in FIG. 6(B).

Further, the core 37 may have a cylindrical shape just at the end portions thereof and the portion of the core 37 which is wound with the ink film 36 may have a form other than the cylindrical shape. Furthermore, provided that the shape of the core 37 is the same for both the take up and supply rolls, then when the ink film 36 has been completely fed to the take ups side, the core 37 of the supply side may be mounted on the take up side and used as the core of the take up side in place of the previous core 37.

Figure 5:
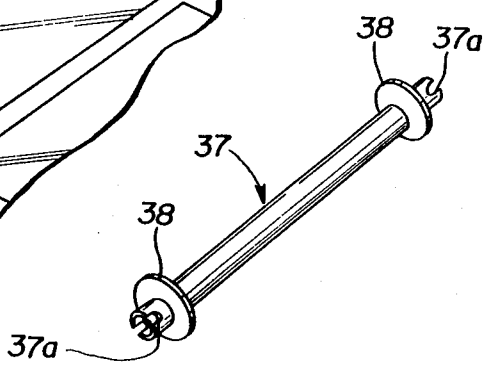
FIG. 5 is a perspective view showing a modification of the core.

FIG. 5 shows a modification of the core. A pair of flanges 38 are formed at a vicinity of opposing ends of the core 37 and are separated by a distance corresponding to the width of the ink film 36. The pair of flanges 38 act to ensure that the ink film 36 is correctly taken up on the core 37 without any deviation therealong.

A description will now be given on the assembly of the take-up roll 34 and the supply roll 35 which have the respective cores 37 wound with or attached to the ink film 36, and also on the construction of the ink roll holding part 32, with reference to FIGS. 6(A), (B) and FIG. 7.

As shown in FIG. 2(A), a pair of mutually opposing guide grooves 39*a* and 39*b* are formed on the inner side of the arms 32*a* and 32*b* constituting the ink roll holding part 32. These guide grooves 39*a* and 39*b* extend upwards to the top side 31*b* of the cartridge body 31 and facilitate the insertion of the take up roll 34 therein at a forward position relative to the supply roll 35. Similarly, a pair of mutually opposing guide grooves 40*a* and 40*b* are formed on the inner side of the pair of arms 32*a* and 32*b* so as to extend up to the bottom side 31*a* of the cartridge body 31 and facilitate insertion of the supply roll 35 therein at a rearward position relative to the take-up roll 34. It is noted that the guide grooves 39*a* and 39*b* have a predetermined arcuate shape corresponding to an arcuate path traced by the swinging motion of the lever of the printer to be described later so that the take-up roll 34 can be smoothly withdrawn from the guide grooves 39*a* and 39*b* by the lever.

Figure 6A:
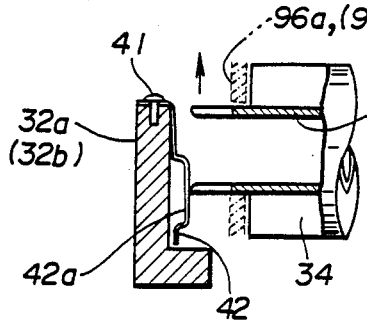
FIG. 6(A) and (B) show a partial sectional view showing a procedure in which a take-up roll for taking up the ink film is mounted on the cartridge.
Figure 6B:
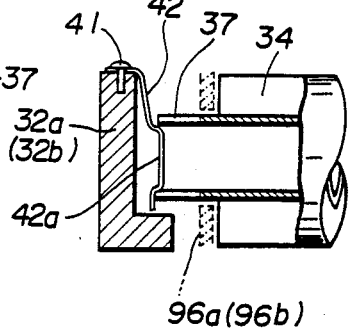
Figure 7:
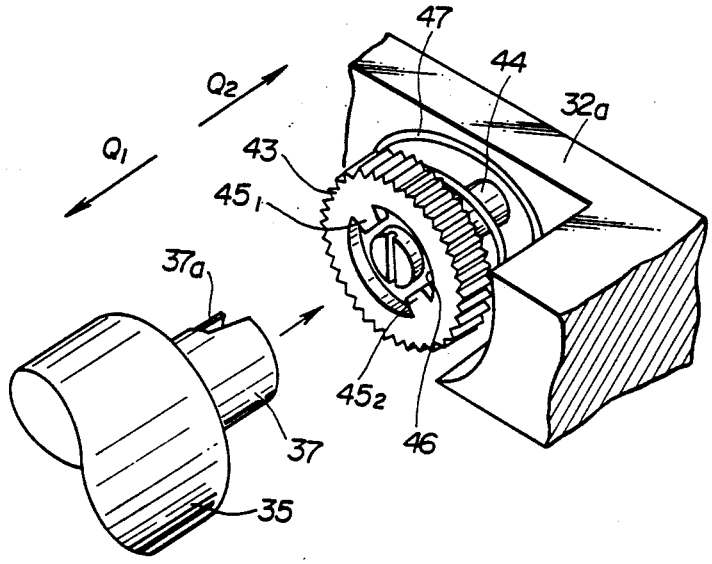
FIG. 7 is a partially enlarged view showing a part for driving a supply roll.

As shown in FIG. 6(A), when inserting both ends of the core 37 of the take up roll 34 into the respective guide grooves 39*a* and 39*b*, the both ends first come into contact with and deflect respective springs 42 which are fixed at one end to the arms 32*a* and 32*b* by screws 41. Thereafter the core 37 reaches a predetermined position of insertion where, as shown in FIG. 6(B), the respective ends of the core 37 are rotatably fitted onto a circular shaped projection 42*a* forming a shaft receiving portion of the respective springs 42. Thus, the core 37 of the take up roll 34 is held flexibly at both ends by the springs 42. Accordingly, when loading the recording paper into the recording paper accommodating part 33 of the cartridge body 31, the take up roll 34 is not displaced from its inserted position because of the resiliency of the spring 42. On the other hand, the force applied by the movement of the arms 96*a* and 96*b* of the printer to be described later to the take up roll 34 is sufficient to remove the take up roll 34 from its elastically held state between the projections 42*a*.

The supply roll 35, on the other hand, is inserted from the bottom surface 31*a* of the cartridge body 31 into the guide grooves 40*a* and 40*b* on the arms 32*a* and 32*b* respectively. Within the guide groove 40*a* of the arm 32*a*, a drive gear 43 is rotatably mounted on a shaft 44 as shown in FIG. 7. On the gear 43, a coupling portion 46 is provided with projections $45_1$ and $45_2$ for engagement with the slots 37*a* of the core 37 and with the outer end of the core 37. Furthermore, a coil spring 47 having a conical form is provided between the arm 32*a* and the drive gear 43 so as to urge the gear 43 in a direction Q1.

Figure 8B:
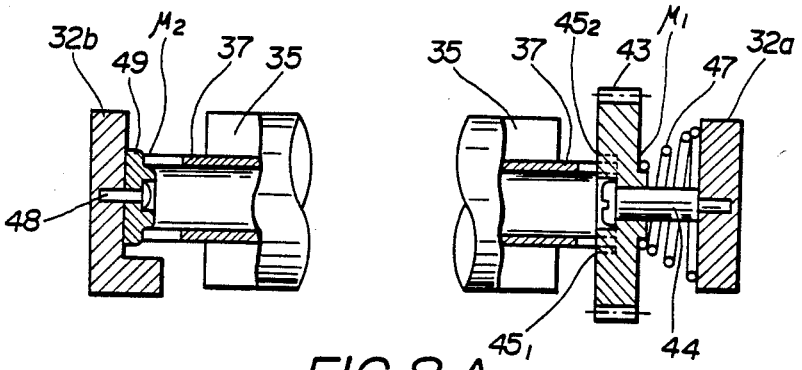
FIGS. 8(A) and (B) are partially enlarged views showing a procedure for mounting the supply roll on the cartridge.
Figure 8A:
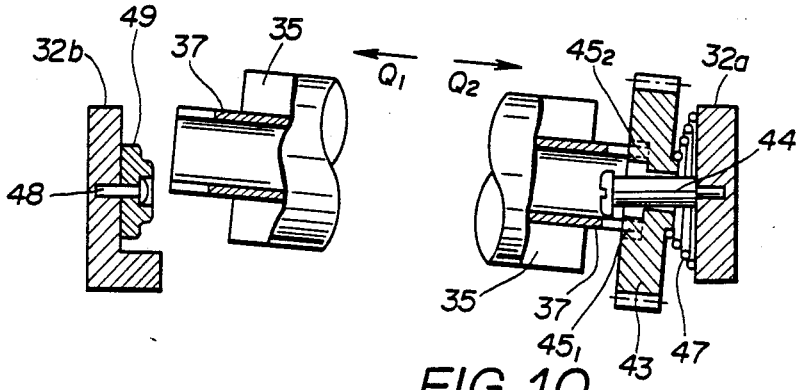

Thus, the supply roll 35 having the core 37 wound with the ink film 36 is inserted into the guide grooves 40*a* and 40*b*, and one end of the core 37 is engaged with the coupling portion 46 of the drive gear 43 as shown in FIG. 8A. Further, as a result of the engagement, the drive gear 43 is displaced in a direction Q2 against the force exerted by the spring 47. Thereafter, as shown in FIG. 8(B), the other end of the core 37 is engaged with a fixed shaft-receiving portion 49 made of a material having a high wear resistance such as a polyester resin and which is fixed by a screw 48 within the guide groove 40*b* of the arm 32*b*. Thereby, the supply roll 35 is flexibly held in centre between the arms 32*a* and 32*b*, with the coil spring 47 applying a force in the axial direction Q1. Due to the force applied by the coil spring 47, there is a friction $\mu_1$ occurring between the coil spring 47 and the drive gear 43, and also a friction $\mu_2$ occurring between the shaft 37 of the supply roll 35 and the fixed shaft receiving portion 49. Due to these frictional resistances, a chance of the ink patterns overrunning a predetermined position is prevented when the ink film 36 is pulled to the position and a loss of tension resulting in slackness which may otherwise develope is eliminated. Thus, a high quality of recording is ensured. A maximum diameter of the rolls 34 and 35 held in the ink roll holding part 32 is chosen so that the rolls 34 and 35 do not project beyond the cartridge body 31.

A description will now be given of the construction of the recording paper accommodating part 33 with reference to FIGS. 2(A) through (C). Referring to the drawings, the recording paper accommodating part 33 having a generally rectangular opening 33*a* in a bottom 31*a* has a holding portion 52 at its rear end so as to be held by the user at the time of insertion or removal of the cartridge 30. The holding portion 52 has a recess opened toward the bottom 31*a* of the cartridge body 31. When supplying recording papers 55 having a width slightly greater than that of the ink film 36, the paper is inserted into the opening 33*a*. Then, the paper is guided by a pair of guide portions 53 and 54 provided on the left and right of the recording paper accommodating part 33 so as to restrict movement of the recording paper 55. The guide portions 53 and 54 may be formed by press moulding or the like. Further, a pair of stopper ribs 56 and 57 are provided to the rear of the recording paper guide portions 53 and 54 respectively. The stopper ribs 56 and 57 cooperate with the stoppers 50*a* and 51*a* respectively and reinforce the cartridge body 31. The cartridge body may be moulded plastic or fibre (paper), of which the latter is preferably for disposal.

Figure 9:
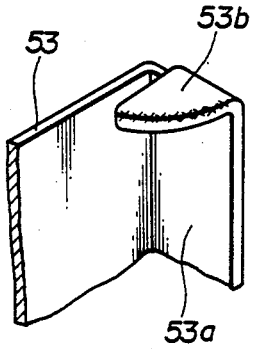
FIG. 9 is an enlarged view showing a finger for holding the paper in the cartridge.

As shown in FIG. 9 a tip end portion of the recording paper guide portion 53 is unitarily formed of a front lip 53*a* extending perpendicularly to the recording paper guide portion 53 and a finger 53*b* formed at a top edge of the front lip 53*a*. The recording paper guide portion 54 has the tip end portion of the same construction which is unitarily formed of a front lip 54*a* and a finger 54*b* which is identical to the finger 53*b* respectively. The fingers 53*b* and 54*b* are provided in order to engage with a front end portion of the recording paper 55. A portion of the finger 53*b* indicated by hatching in FIG. 9 is polished so that it is ensured that any undesirable burr formed as a result of moulding and the like are removed. Similarly, a portion of the finger 54*b* is polished with a same degree of finishing. As shown in FIG. 2(C), the finger 53*b* is oriented at a slightly inclined angle $\alpha$ with respect to the bottom surface 31*a* of the cartridge body 31. As a result of the the inclined angle and the finish given to the fingers 53*b* and 54*b*, the recording paper can be supplied to the printer with ease.

On the inner sides of the guide portions 53 and 54, a movable tray 61 (FIG. 2(C)) is provided. This movable tray 61 has pivot pins 59 and 60 on either side at a position close to a top plate 58 of the cartridge body 31 and located between a rear end of the recording paper guide portions 53 and 54 and the respective ribs 56 and 57. Further, the movable tray 61 is urged in a direction M in FIG. 2(C) by a coil spring 63 positioned between a projection 62 on the movable tray 61 and a depression 58*a* provided in the upper wall 58. Thus, a plurality of sheets of the recording paper 55 placed on the movable tray 61 are urged by the force exerted by the coil spring 63 toward the fingers 53*b* and 54*b*. By fitting the coil spring 63 in the manner described above, it is ensured that the coil spring 63 will not move from its seated position and than no noise is generated during compression and expansion of the coil spring 63. Further, the height of the conical shape spring 63 in a fully compressed state is equal to the thickness of the spring wire thereof, and thus the coil spring 63 can be compressed until the upper wall 58 and the movable tray 61 are in mutual contact. As a result, it is possible to insert a plurality of the recording paper 55 stacked up to a thickness approaching the thickness of the cartridge body 31 itself.

By setting the number of the paper 55 held in the recording paper accommodating part 33 such that the number of papers coincides with the number of groups of the primary color ink patterns or frames provided on the film 36, it is possible to make sure that the moment at which the the recording paper 55 is used up and the moment in which the ink film 36 is used up occur at the same time. In such a case, one can simply replace the cartridge with a new one when replenishing the paper and the film, and can discard the old one. It should be noted that the one paper corresponds to one ink pattern of the ink film 36 for printing monochrome image in one color, while in the case of the color printing, a group of ink patterns having respectively three primary color Y, M and C (and optional black if used) corresponds to one frame of image or picture to be printed on one sheet of the recording paper.

Figure 10:
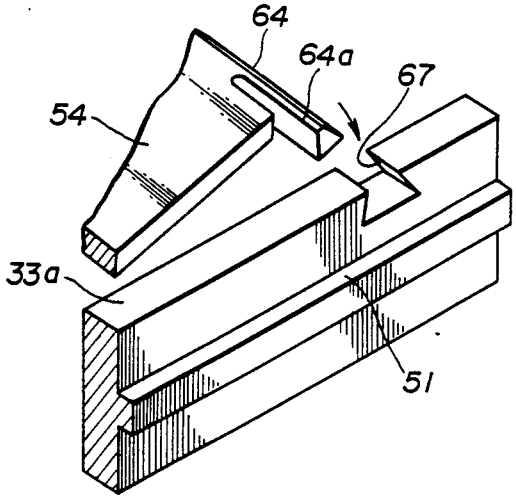
FIG. 10 is a partially enlarged view showing an engagement of a lid with the cartridge.
Figure 111:
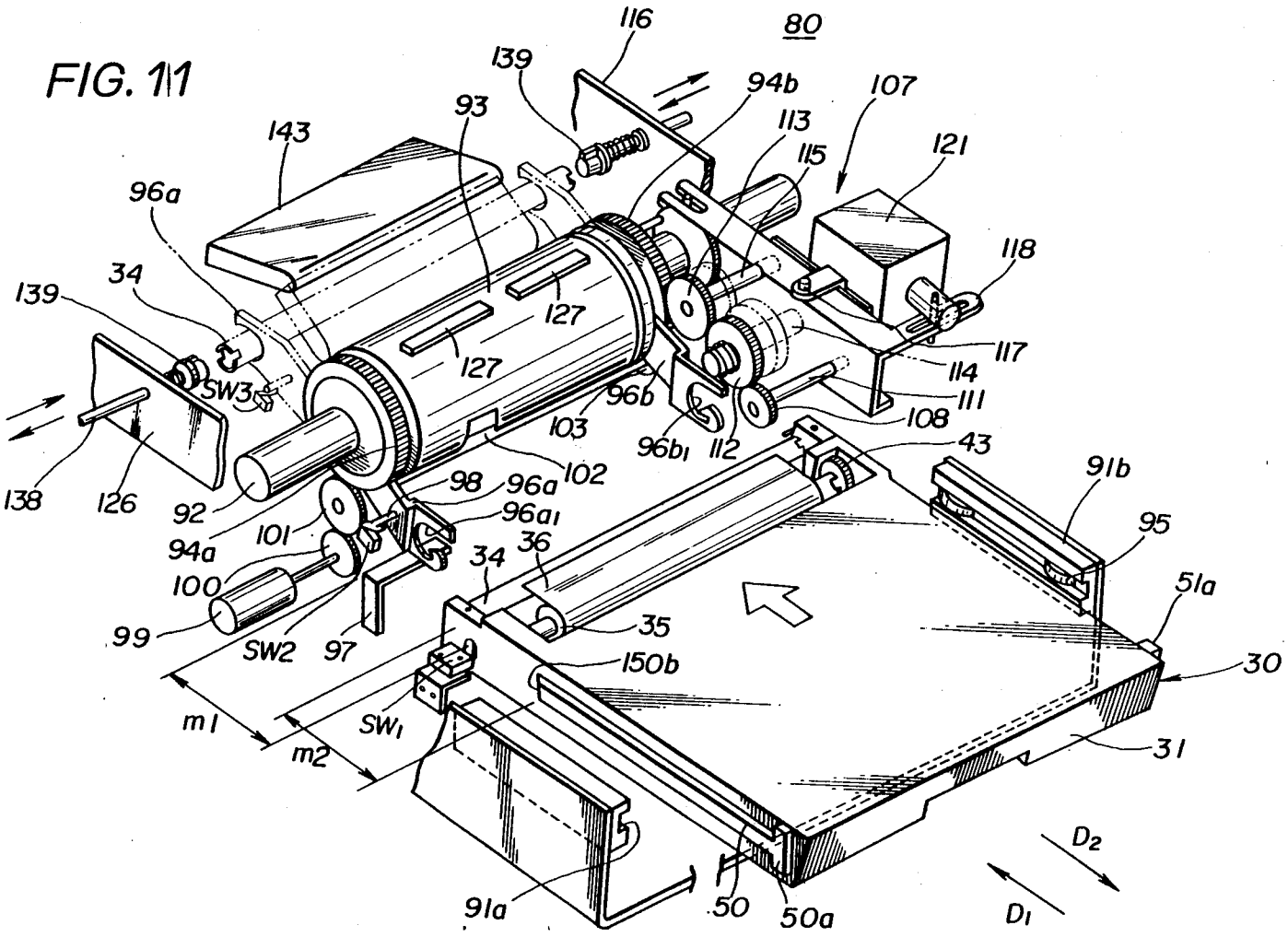

FIG. 2(A) further shows a lid member 64 which is provided rotatably around pins 65 and 66 provided at a rear part of the opening 33*a* of the recording paper accommodating part 33 so as to close the opening 33*a*. The lid member 64 carries a pair of elastically deformable fingers 64*a* extending laterally on its front end. As can be seen in the enlarged view in FIG. 10, the finger 64*a* is engaged with a cutout 67 formed on the cartridge body 31 by deforming resiliently. Thus, the lid member 64 is locked when it is closed and accidental drop out of the paper 55 from the cartridge 30 is positively prevented.

FIG. 2(C) further shows a friction sheet 68 made of a material such as a cork and disposed centrally at an upper surface of the movable tray 61 at a position close to the front end of the tray 61. This friction sheet 68 prevents the feeding of the paper 55 in the overlapped state and ensures that the last paper in the recording paper accommodating part 33 is reliably fed to the printer. The coefficient of friction of the friction sheet 68 is determined so as to satisfy a relation $a>b>c$, where a stands for the friction between a paper feed roller to be described and the recording paper 55, b stands for the friction between the recording paper and the friction sheet 68, and c stands for the friction between recording papers stacked each other in the recording paper accommodating part 33 of the cartridge 30. In order to realize such a relation, the spring constant of the conically shape spring 63 is adjusted. Further, by the use of the fingers 53*b* and 54*b* having the inclined angle $\alpha$ which is set to 5–15 degrees downwards, the separation of the paper from the stack of the papers in the recording paper accommodating part 33 is performed with excellent reliability. Furthermore, as will be described later, the paper 55 fed to the printer is printed with images on the side which is opposite to the side on which the paper feed roller is engaged. Thus, the surface of the paper carrying the images is not messed up even if slipping occurs between the paper 55 and the paper feed roller. Further, as the printing is made on the lower side of the paper stacked and accommodated in the recording paper accommodating part 33 of the cartridge, the deposition of dust or fingerprint on the recording surface of the paper in the uppermost layer of the stack of paper is prevented and excellent printing can be maintained up to the last of the papers in the cartridge 30.

Referring to FIG. 2(A), again, an elongated hole 69 is provided at a front part of the movable tray 61. When the cartridge 30 is loaded into the printer and the paper 55 in the cartridge 30 is completely used, a photo sensor provided on the printer so as to face the hole 69 loses detection of the reflection of light from the paper 55 in the cartridge 30, and the printer is stopped. At the same time, a warning lamp indicating the replenishment of the paper is illuminated. For this purpose, the cartridge 31 may be applied with a suitable surface coating and the like to eliminate reflection of light from the body of the cartridge.

Next, a description will be given of a preferred embodiment of the printer of the present invention designed to use the cartridge 30 as described heretofore with reference to FIGS. 11 through 24.

Figure 12:
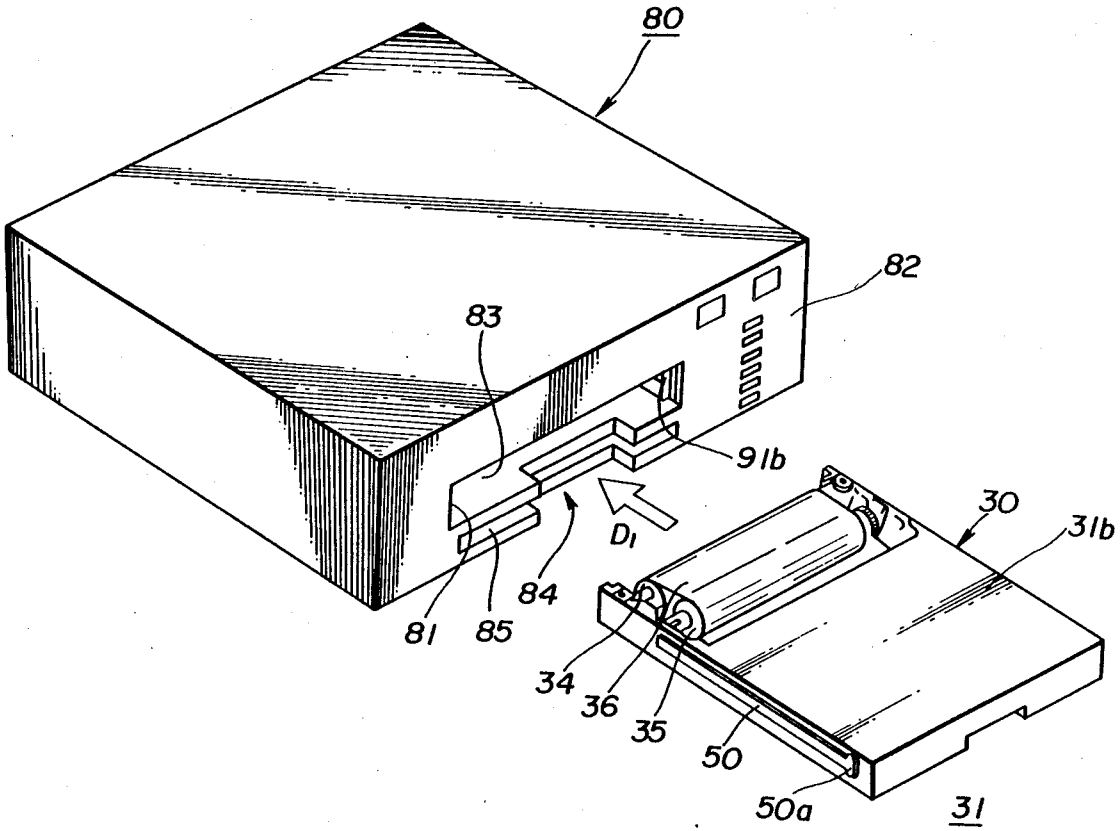
FIG. 12 is a perspective view showing the recording apparatus of FIG. 11 together with the cartridge at the time of loading.

Referring to FIG. 12, a printer 80 has an insertion opening 81 on its front panel for accepting the insertion of the cartridge 30. As a result of the loading operation, the cartridge 30 is accommodated in a space 83 defined in the body of the printer 80. It should be noted that the cartridge is inserted into the printer 80 as shown by an arrow $D_1$ with such a state that the opening 33*a* of the cartridge 30 faces downwards and that the ink roll holding part 32 of the cartridge 30 is inserted first. At the time of loading, the ribs 50 and 51 provided on the side walls of the cartridge body 31 are engaged with guide grooves 91*a* and 91*b* and the cartridge 30 is loaded smoothly. In the loaded state, the cartridge 30 is urged by a spring member 95 (FIG. 11) provided in the guide groove 91*b* toward the guide groove 91*a* and the cartridge 30 is thus restricted in position in the lateral direction. As a result, the cartridge 30 is directed properly to the printer 80 and the zigzag movement of the paper 55 fed from the cartridge 30 is prevented. Thus, the paper 55 is fed from the cartridge 30 with excellent reliability. In the fully loaded state, it is noted that the stoppers 50*a* and 51*a* (FIG. 11) are abutted to the end of the guide grooves 91*a* and 91*b*. FIG. 12 further shows a cutout 84 formed at a portion of the printer 80 located below the insertion opening 83 so that the user can easily draw out the cartridge 30 from the printer 80 at the time of unloading the cartridge. It should be noted that the rear end of the cartridge 30 becomes flush with the front panel 82 of the printer 80.

In case the user of the printer 80 has loaded the cartridge 30 upside down, the insertion of the cartridge is prevented because the ribs 50 and 51 are provided on the body of the cartridge with a mutually asymmetric state and also because the rib 50 cannot be engaged with the opposite groove 91*b* and the rib 51 cannot be engaged with the opposite groove 91*a*.

When the cartridge 30 properly loaded into the printer 80 has reached a predetermined fully loaded state in which the cartridge 30 is fully inserted into the printer 80, a switch SW1 disposed in the printer so as to face a slope 50*b* formed at the front end of the rib 50 is closed by the move of the rib 50, and responsive thereto, the take up roll 34 is transferred from the cartridge 30 to a predetermined position in the printer 80 and the printer 80 becomes ready for printing. More specifically, responsive to the loading of the cartridge 30 on the printer 80, the both ends of the core 37 of the take up roll 34 are transported to respective sides of a platen roller 93 which is held rotatably on the printer 80 around a rotational shaft 92. In this state, the core 37 is held in U-shaped portions 96*a*$_1$ and 96*b*$_1$ formed at an end of arms 96*a* and 96*b* which is provided integral with drive gears 94*a* and 94*b* which in turn are provided so as to rotate around the shaft 92 of the platen roller 93 (see FIG. 22). In order to assure a proper engagement between the arms 96*a*, 96*b* and the core 37 of the take up roll 34, the U-shaped portion 96*a*$_1$ is configured such that the distance $m_1$ between the portion 96*a*$_1$ and the switch SW1 and the distance $m_2$ between the centre of the take up roll 34 in the cartridge 30 and the slope 50*b* at the front end of the rib 50 are kept identical. Further, the arm 96*a* is abutted with an L-shaped stopper 97 provided in the printer so as to restrict the position of the arm 96*a*. Thus, the position of the arms 96*a* and 96*b* are determined unambiguously at the time of insertion of the cartridge 30. Therefore, the take up roll 34 is accepted into the U-shaped opening 96*a*$_1$ and 96*b*$_1$ securely and the possibility of improper engagement is eliminated.

It is noted that the openings 96*a*$_1$ and 96*b*$_1$ are configured such that the lower edge of an upper leg defining the openings 96*a* and 96*b* are made flat and the upper edge of a lower leg defining these openings 96*a* and 96*b* have a hook. Further, the entrance to the openings 96*a*$_1$ and 96*b*$_1$ are made narrower as compared to the inside of the openings. Actually, this entrance is made slightly narrower than the outer diameter of the core 37 of the take up roll 34, and the upper leg and the lower leg defining the opening 96*a*$_1$ and 96*b*$_1$ are made of a resilient material. As a result, the entrance of the U-shaped openings 96*a*$_1$ and 96*b*$_1$ are expanded elastically when the core 37 is inserted into the openings. It should be noted that this resiliency of the U-shaped openings may be obtained by constructing the arms 96*a* and 96*b* by a resilient metal or by constructing the U-shaped openings 96*a*$_1$ and 96*b*$_1$ by resilient plastic and mounting them at the end of the arms 96*a* and 96*b*. Further, the construction of the U-shaped opening may be any known construction as long as the portion of the arm is deformed elastically responsive to the insertion of the core 37 and as long as the core 37 is held rotatably in the openings 96*a*$_1$ and 96*b*$_1$.

Figure 25B:
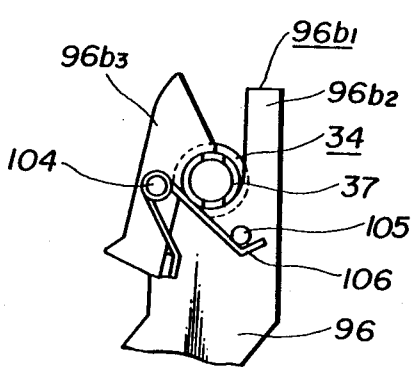
FIGS. 25(A) and (B) are side views of the thermal imprint recording apparatus showing another embodiment of the arms carrying the take up roll.
Figure 25A:
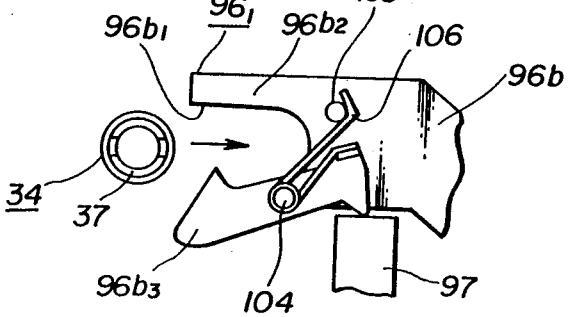

FIGS. 25(A) and (B) show another embodiment of the arms 96*a* and 96*b* for holding the take up roll 34. In the drawing, only one of the arms, 96*b*, are shown as the construction of the arm 96*a* is identical to those of the arm 96*b*. Referring to the drawing, the arm 96*b* is made of a metal and the U-shaped opening 96*b*$_1$ comprises a horizontal part 96*b*$_2$ and a catch 96*b*$_3$ provided rotatably on the arm 96*b*. The catch 96*b*$_3$ is held rotatably on the arm 96*b* by a pin 104 and is urged in the clockwise direction to close the entrance to the U-shaped opening 96*b*$_1$ by a spring 106 wound around the pin 104 and having one end abutted to the catch 96*b*$_3$ and the other end engaged with a pin 105. Thus, when carrying the take up roll 34 on the arm 96*b* at the time of insertion of the cartridge 30 on the printer 80, a projection at the base of the catch 96*b*$_3$ is first engaged with the stopper 97 of the printer 80 and the catch 96*b*$_3$ is rotated in the counter clockwise direction against the force of the spring 106. Thus, the entrance of the core 37 into the opening 96*b*$_1$ is allowed. In this procedure, the position of the arm 96*b* is restricted by the stopper 97 and at the same time the U-shaped opening 96*b*$_1$ is opened. On the other hand, after the insertion of the cartridge 30 into the apparatus 80 is completed and the arm 96*b* is rotated, the entrance to the U-shaped opening 96*b*$_1$ is closed as the catch 96*b*$_3$ is rotated clockwise by the urging force of the spring 106. Thus, the core 37 of the take up roll 34 is securely held in the depression formed in the catch 96*b*$_3$ and an accident such that the roll is disengaged from the arm 96*b* and falls during the transport of the roller 34 is positively prevented.

Referring to FIG. 11 again, the position of the arm 96*a* is restricted by the stopper 97, and in this state, the arm 96*a* closes a switch SW2 by a pin 98 carried by the arm 96*a*. Further, in this horizontal state of the arm 96*a*, the U-shaped opening 96*a*$_1$ is opened so as to allow entrance of the cartridge 30. When the arm 96*a* is rotated to a state shown by a two-dotted line shown in FIG. 11 by a motor 99, the pin 98 closes the switch SW3 and the motor 99 is deenergized. The position of the switches SW2 and SW3 are determined such that they are located slightly offset against the direction of movement of the arm 96*a* relatively to the stationary position of the arm 96*a* so as to compensate the effect of inertia of the arm. Further, the position of the switches SW2 and SW3 are adjustable at the time of assembling the printer 80. Furthermore, it is noted that the effect of inertial of the motor 99 can be eliminated even in such a case that the arm 96*a* is contacted with the stopper 97 violently by providing a known slip clutch mechanism between the motor 99 and a gear 100 on the output shaft of the motor 99 so as to absorb the effect of inertia of the motor 99. Such a construction is preferable in order to realize a stable and reliable movement of the arm 96*a*.

Responsive to the completion of the loading of the cartridge 30 in the printer 80, the arm motor 99 is energized by the closure of the switch SW1. Responsive to the rotation of the arm motor 99 carrying the gear 100, a gear 101 meshing with the gear 100 is rotated and responsive to the rotation of the gear 101, the aforementioned drive gear 94*a* is rotated. The gear 94*a* carries the shaft 92 and the arms 96*a* and 96*b* are rotated responsive to the rotation of the gear 94*a* around the shaft 92. It should be noted that another gear 103 is connected to the gear 101 by a shaft 102 so as to rotate unitarily with the gear 101, and the other drive gear 94*b* is engaged with the gear 103. Thus, responsive to the movement of the arm 96*a* driven by the gear 94*a*, the arm 96*b* is moved simultaneously with a same speed by the gear 94*b*. It is obvious that one can use optically triggered switches in place of the switches SW1–SW3.

Responsive to the rotation of the drive gears 94*a* and 94*b*, the arms 96*a* and 96*b* are rotated in the counter clockwise direction and removed the take up roll 34 carried at the end of the arms from the ink roll holding part 32 of the cartridge 30. Thus, responsive to the rotation of the arms 96*a* and 96*b*, the take up roll 34 is transported along the arcuate guide grooves 39*a* and 39*b* of the cartridge 30 and is separated from the guide grooves through the opening 32*c* of the ink roll holding part 32.

Figure 13:
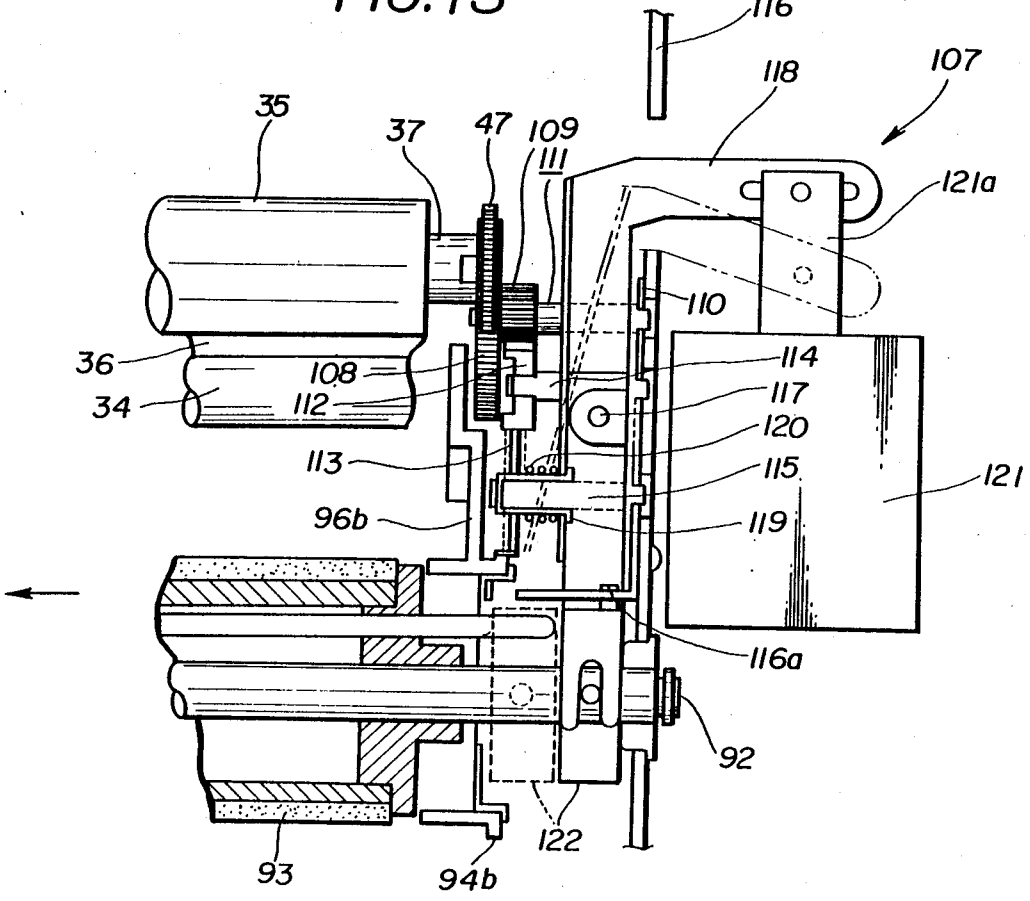
FIG. 13 is an enlarged view showing a mechanism for feeding and taking up the ink film.

When the cartridge 30 is inserted into the printer 80, the gear 43 which rotates unitarily with the supply roll 35 is meshed with a drive gear 108 of a take up mechanism 107 for taking up the ink film on the core 37. In the description hereinafter, the construction of the take up mechanism 107 particularly at the time of removal of the cartridge 30 from the printer 80 will be described with reference to FIG. 13. Referring to FIG. 13, the drive gear 108 of the ink film take up mechanism 107 carries a gear 109 unitarily formed therewith and the gears 108 and 109 are held rotatably on a pin 111 provided on a guide member 110 which in turn is fixed on a frame 116 of the printer 80. Further, the drive gear 108 is meshed permanently with a gear 113 via an intermediate gear 112. The gears 108, 112 and 113 are held rotatably on respective pins 111, 114 and 115 fixed on the guide member 110. The gear 113, on the other hand, is held slidably on the pins 115 and carries a sleeve extending through a clamp lever 118 which is supported rotatably on a pin 117 provided on the guide member 110. Further, the sleeve is provided with a stopper 119 which is engaged with the clamper lever 118. The gear 113 is urged by a spring 120 fitted over the pin 115 between the gear 113 and the clamp lever 118. The clamp lever 118 has one end connected to an actuating rod 121*a* of a solenoid actuator 121 and another end for holding a slidable ring 122 fitted over the rotary shaft 122 of the platen roller 93. Thus, when the solenoid actuator 121 is actuated from a non-actuated state shown in FIG. 13 by a solid line to an actuated state shown by a two-dotted line, the clamp lever 118 is rotated around the shaft 117 in the clockwise direction as shown by the two-dotted line. Responsive to the rotation of this clamp lever 118, the gear 113 is displaced to the left along the shaft 115 while maintaining engagement with the gear 112 by the force exerted by the spring 120. In this state, the gear 113 is meshed with the drive gear 94*b* of the arm 96*b* and the swinging motion of the arm 96*b* is transmitted to the gear 43 in the cartridge 30 via the gears 94*b*, 113 and 112. Thus, the gear 43 of the supply roll 35 is rotated backwards responsive to the movement of the arms 96*a* and 96*b* in the backward direction to return the take up roll 34 at the time of removal of the cartridge 30 from the printer 80. As a result of this operation, the ink film 36 which was drawn out previously from the cartridge 30 is re-wound on the supply roll 35 and the slackening of the film 36 at the time of returning the take up roll 34 to the cartridge 30 is eliminated.

Further, as a result of rotation of the clamp lever 118, the slidable ring 122 is displaced so as to urge a clamp shaft 123 of the platen roller 93 in the direction shown by an arrow. As a result, the clamping of the paper is removed as will be described later and the discharge of the paper becomes possible. It should be noted that the rotation of the ring 122 is prevented by a pin 116*a* provided on the frame 116.

Figure 21:
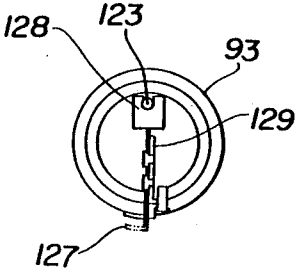
FIG. 21 is a sectional view of the platen roller.
Figure 20:
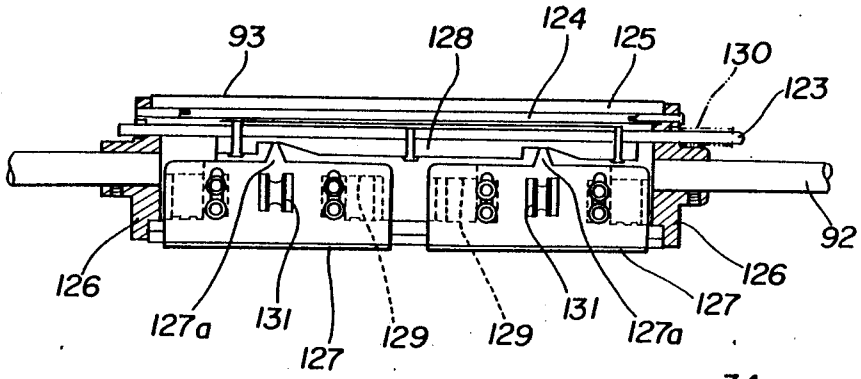
FIG. 20 is a view showing the construction of the interior of the platen roller.

Next, description will be given on the detailed construction of the platen roller 93 with reference to FIGS. 20 and 21. Referring to FIG. 20, the platen roller comprises a cylindrical member 124 and a rubber covering 125 which covers the periphery of the cylindrical member 124. The both ends of the cylindrical member 124 are closed by a pair of flanges 126, and the flanges 126 are fixed to the aforementioned rotary shaft 92. Further, the platen roller 93 comprises a clamper 127 which is provided so as to be movable in the radial direction of the cylindrical member 124. The clamper 127 has a projection 127*a* on its base part, and the projection 127*a* is engaged with a cam 128 formed on the aforementioned clamp shaft 123 extending through the cylindrical member 124. Thus, responsive to the movement of the cam shaft 123 in the longitudinal direction of the cylindrical member 124, the clamper 127 is lifted outwards against an urging force exerted by a spring 131. Further, a leaf spring member is inserted between the clamper 127 and a stationary plate 129 fixed inside the cylindrical member 124 for absorbing any rattling of the clamper 127 in the circumferential direction. It can be seen that the clamper 127 further has a clamping part which is a bent portion formed at the outer end of the clamper 127. This clamping part has a curvature which is substantially coincident to the curvature of the platen roller 93 and holds the recording paper on the platen roller securely. As a result, the overlapped printing of images with different color on a same recording paper for color printing can be performed with high precision and high reliability. In order to hold the paper on the platen roller 93 with increased engaging force, one may provide minute projections on the radially inner surface of the clamping part of the clamper 127.

Figure 17:
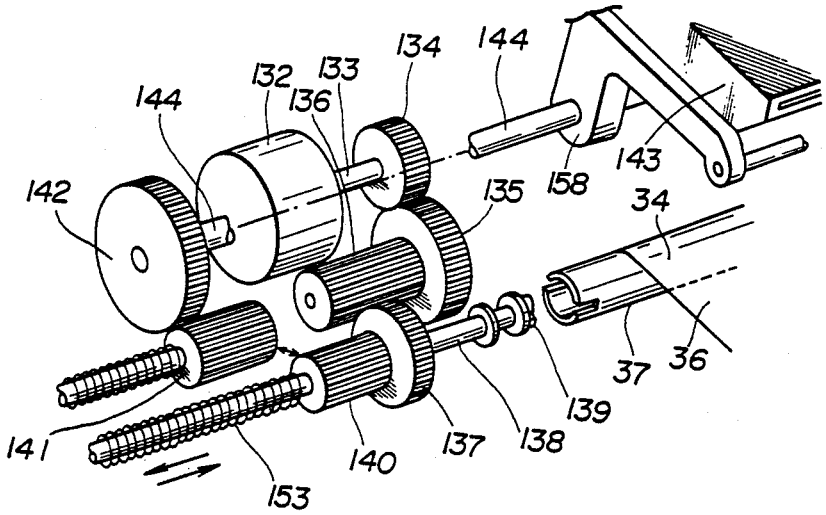
FIG. 17 is a schematical view showing a driving mechanism for driving a shaft used to drive a take up roll of the ink film shown in FIG. 4.

Next, the operation for displacing the thermal head and for driving the take up mechanism of the printer at the time of transportation of the take up roll 35 by the arms 96*a* and 96*b* will be described with reference to FIGS. 17–19(B). Referring to FIG. 17, a motor 199 is used to drive the ink film 36 as well as to displace the thermal head away from the platen roller at the time of loading the ink film 36 on the platen roller 93. The rotation of the motor 132 is transmitted to a drive shaft 138 for driving the core 37 of the take up roll 34 via a gear 134 carried on an output shaft 133 of the motor 132, a gear 135 permanently meshed with the gear 134, a gear 136 provided unitarily with the gear 135, and a gear 137 permanently meshed with the gear 136. At both ends of the shaft 138, coupling members 139 and 139 are provided so as to engage with the core 37 of the take up roll 34. The shaft 138 is further constructed so as to be movable in the directions as indicated by arrows in FIG. 17. Therefore, the shaft 138 can be displaced towards the left when replacing the ink film 36 so that the core 37 is disengaged from the shaft 138. It should be noted that in this displaced state, a gear 140 which is formed unitarily with the gear 137 is engaged with a gear 141 which in turn is meshed with a gear 142 used for displacing a thermal head 143. It is noted that the gear 142 is carried by a shaft 144 which is connected to a mounting base 158 of the thermal head 143.

Thus, in the state in which the shaft 138 for driving the take up roll 34 is displaced towards the right in FIG. 17, the rotation of the motor 132 is transmitted to the take up roll 34 and the ink film 36 is wound on the roll 34. Thus, the film 36 is transported across the platen roller 93 as will be described. In this state, the gear 140 and the gear 141 are disengaged and the thermal head 143 is not displaced from its normal position adjacent to the platen roller 93. On the contrary, in the state in which the drive shaft 138 is displaced towards the left in FIG. 17, the rotation of the motor 132 is not transmitted to the core 37 of the take up roll 34 but is transmitted to the shaft 144 as a result of meshing of the gear 140 with the gear 141. As a result, the thermal head 143 is displaced from the normal position adjacent to the platen roller 93 responsive to the rotation of the shaft 144.

Figure 18:
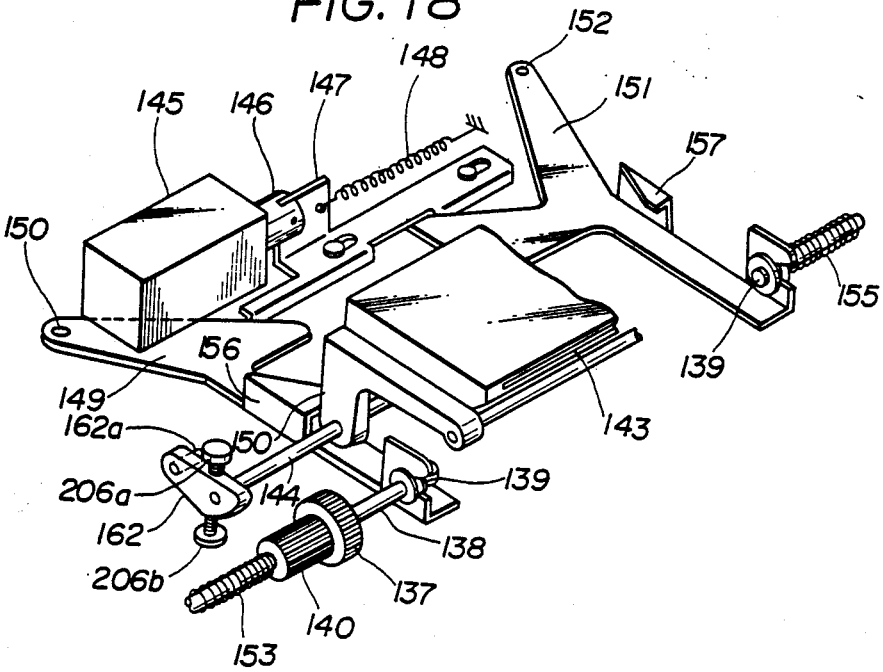
FIG. 18 is a perspective view showing a mechanism for displacing a thermal head.
Figure 19A:
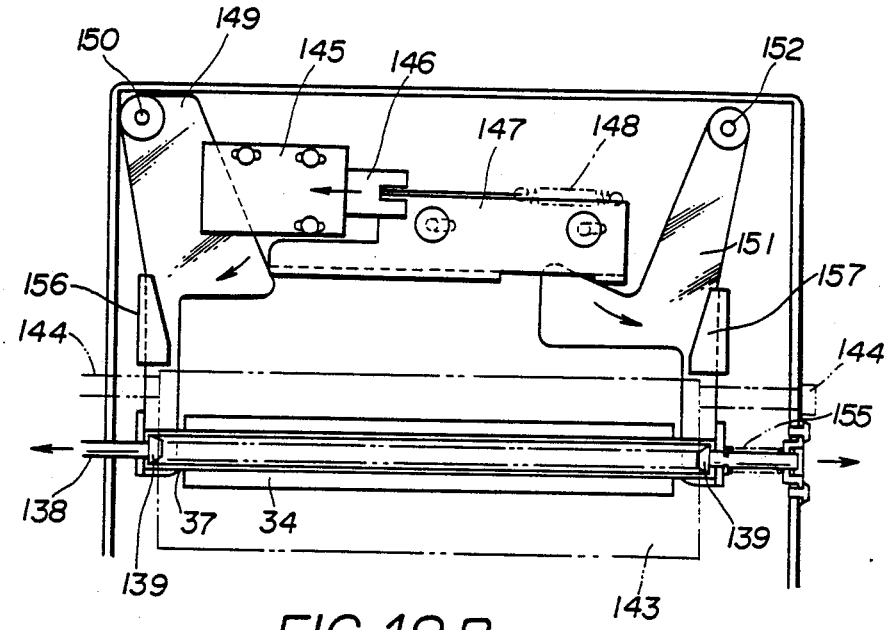
FIGS. 19(A) and (B) are views showing a mechanism for controlling the engagement of a drive shaft with a take up roll of the ink film.
Figure 19B:
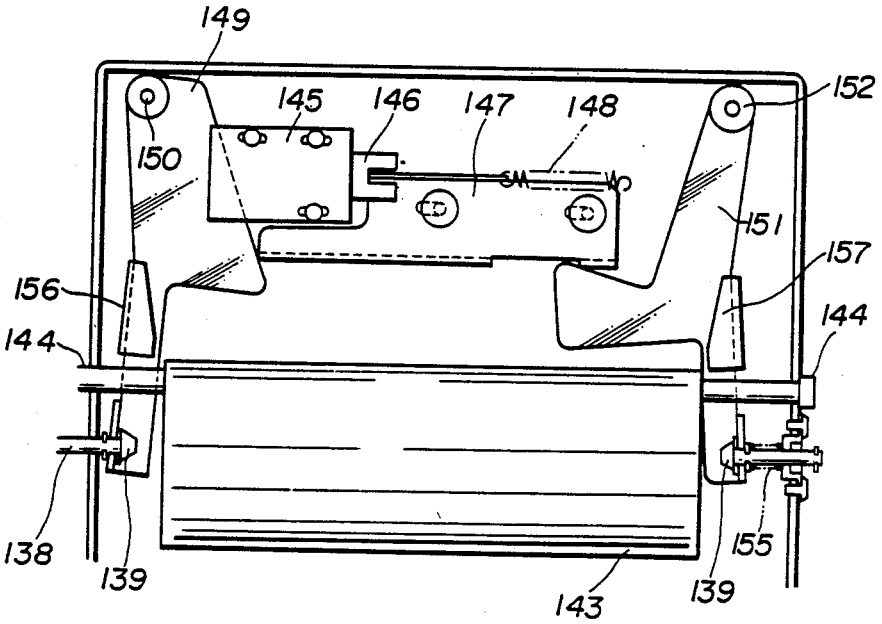

FIGS. 18, 19(A) and (B) show a mechanism for displacing the drive shaft 138 of the take up roll 34. Referring to the drawings, an actuator core 146 of a solenoid 145 is displaced inwards responsive to a trigger signal supplied thereto commanding the displacement of the thermal head 143 from its normal position, and responsive thereto, a moving plate 147 connected to the core 146 is displaced towards the solenoid 145 against an urging force by a spring 148. As a result, the lever 149 is rotated in the clockwise direction about a centre of rotation 150 of the lever 149. As the end of the drive shaft 138 is connected to the lever 149, the shaft 138 is displaced towards the left in FIG. 18 responsive to the rotation of the lever 149. Thus, the the coupling member 139 and the take up roll 34 are disconnected. Further, responsive to the movement of the moving plate 147, a lever 151 which is disposed so as to oppose the lever 149 is rotated in the counter clockwise direction about a centre of rotation 152. As a result, the other coupling member 139 is displaced towards the right in the drawing, and the coupling member 139 is disconnected from the take up roll 34. Further, when the solenoid 145 is deenergized, the aforementioned parts are returned to the state shown in FIG. 18 and FIG. 19(A).

FIG. 18 further shows another lever 162 which is held rotatably about a shaft 162*a*. The lever 162 is held by adjusting screws 206*a* and 206*b* disposed above and below the lever 162 and the position of the shaft 144, in other words, the centre of rotation of the thermal head 143 is adjusted by the screws 206*a* and 206*b*. Thus, the position of the thermal head can be optimized relative to the platen roller 93 and a high quality printing becomes possible as a result of such optimization.

Figure 22:
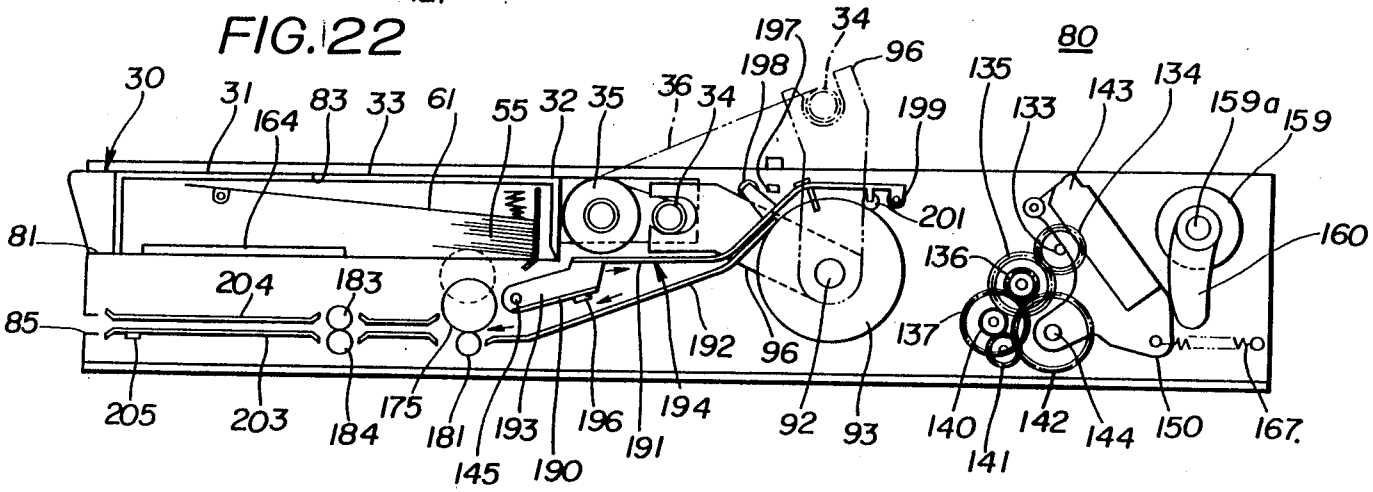
FIGS. 22, 23, and 24 are side views showing an operation of the thermal imprint recording apparatus accompanying the movement of the take-up roll within the cartridge.
Figure 23:
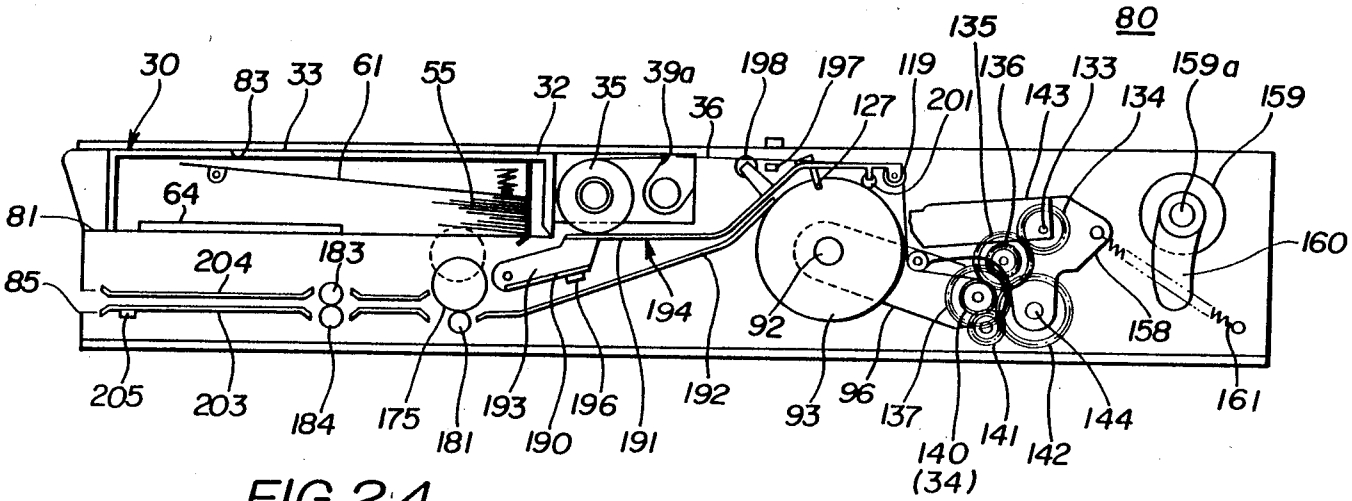
Figure 24:
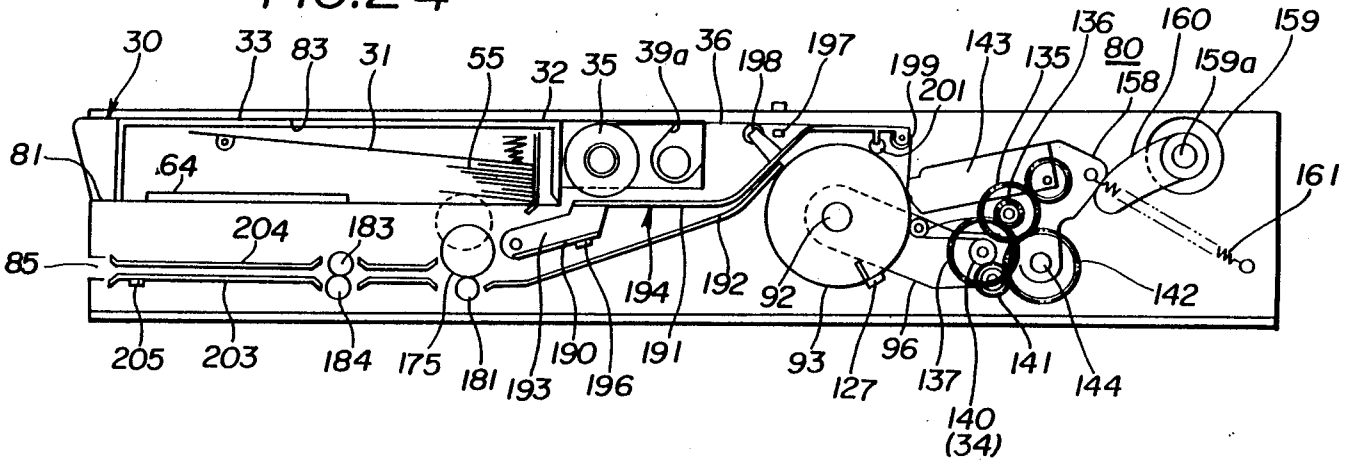

FIGS. 22–24 show a rotary solenoid actuator 159 disposed behind the mounting base 158 of the thermal head 143. The solenoid actuator 159 carries an arm 160 on its rotary shaft 159*a*. As can be seen in FIG. 24, the arm 160 is driven by the actuator 159 and urges the mounting base 158 of the thermal head 143 such that the thermal head is pressed on the surface of the paper 55 on the platen roller 93 via the ink film 36. Further, the mounting base 158 is returned to an unurged state shown in FIG. 23 by a spring 161 when the actuator 159 is deenergized.

In the printer 80 having a construction described heretofore, levers 149 and 151 are moved responsive to the energizing of the solenoid actuator 145 shown in FIG. 18 when replacing the ink film 36, and responsive to the movement of the levers, the drive shaft 138 is displaced towards the left in FIG. 18 and the core 37 of the take up roll 34 is disengaged from the coupling member 139. Further, responsive to the movement of the drive shaft 138 towards the left, the gears 141 and 142 shown in FIG. 17 are engaged, and the rotation of the motor 132 is transmitted to the shaft 144 via the gears 134, 135, 136, 137, 140, 151, and 142. As a result, the shaft 144 is rotated in the counter clockwise direction in FIGS. 17 and 18. It should be noted that, in FIG. 23, the shaft 144 is rotated in the clockwise direction since FIG. 23 shows the printer seen from the opposite direction to FIGS. 17 and 18. Thus, the thermal head 143 is displaced from the platen roller 93 as shown in FIG. 22, and once the thermal head is displaced for sufficient distance, this movement of the thermal head is detected by a means not illustrated, and the motor 132 is stopped.

Next, the arms 96*a* and 96*b* are rotated in FIG. 22 in the counter clockwise direction and the take up roll 34 is returned to the ink roll holding part 32 of the cartridge 30. When returning the take up roll 34 to the cartridge 30, the take up roll 35 is driven in the reversed direction by the aforementioned mechanism 107, and the ink film 36 is wound on the supply roll 35. After the removal of this old cartridge and insertion of a new cartridge 30 into the printer 80, the switch SW1 shown in FIG. 11 is actuated and the motor 99 driving the arms 96*a* and 96*b* is energized. Thus, the arms 96*a* and 96*b* are rotated about the shaft 92 and the take up roll 34 is transported across the platen roller 93 to a predetermined loading position. As the take up roll 34 is moved across the platen roller 93, the ink film 36 is drawn over the platen roller 93 and the film 36 is partially wound around the platen roller 93. When the arm 96*a* reaches a predetermined position, the switch SW3 is actuated and the motor 99 is deenergized. During this movement of the arms, the thermal head is displaced away from the platen roller as shown in FIG. 22. After the deenergizing of the motor 99, the motor 132 shown in FIG. 17 is energized in the reverse direction and the drive shaft 144 is rotated in the counter clockwise direction in FIG. 22. Thus, the thermal head 143 is moved to the normal position adjacent to the platen roller 143. This state is detected by a detection means not illustrated, and the motor 132 is deenergized. At the same time, the solenoid actuator 145 is deenergized and the coupling members 139 are returned so as to engage with the core 37 of the take up roll 34. Further, the engagement of the gears 140 and 141 is disconnected and the rotation of the motor 132 is transmitted to the take up roll 34 alone. Thus, the take up of the ink film is performed.

Figure 14:
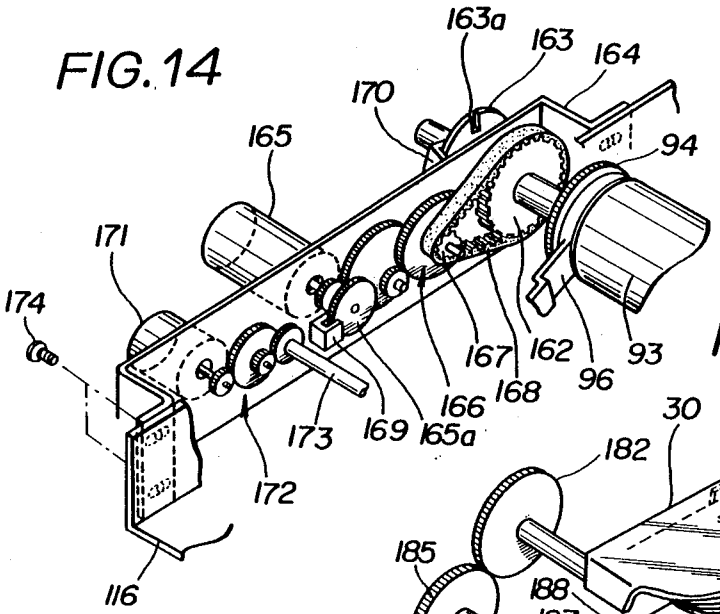
FIG. 14 is a perspective view showing a mechanism for driving a platen roller.

Next, a mechanism for driving the platen roller 93 will be described with reference to FIG. 14. In FIG. 14, the rotary shaft 92 of the platen roller 93 carries a disk-shaped sensor plate 163. Further, the platen roller 93 is rotated by a D.C. motor mounted on a mounting base 164 with a reduced speed reduced by a factor of several hundred times as compared to the rotational speed of the D.C. motor 165, by a reduction gear system 166 as well as by a belt and pulley mechanism comprising a toothed pulley wheels 162, 167, and a belt 168 carrying teeth for engagement with the pulley wheels. The motor 165 carries a gear 165*a* on its output shaft, and a photo detecting mechanism 169 is provided adjacent to the gear 165*a* so as to detect the movement of the teeth on the gear 165*a* as a result of interruption of light by the teeth and produces an output pulse corresponding to the rotation of the gear 165*a*. The aforementioned sensor plate 163, on the other hand, has a slit 163*a* extending radially on the plate, and a photo detecting mechanism 170 is disposed on the mounting base 164 so as to detect the slit 163*a* during the rotation of the sensor plate 163. Thus, the photo detecting mechanism 170 produces an output signal indicating the rotational angle of the platen roller 93, and responsive to this output signal, the state of a paper feeding mechanism for feeding the recording paper 55 on the platen roller 93 is set. FIG. 14 further shows a motor 171 for driving a drive shaft 173 of a feed roller to be described with a reduced speed via a reduction gear system 172.

As can be seen in FIG. 14, the drive mechanism of the platen roller is carried by the mounting base 164 which in turn is mounted on the frame 116 by a screw 174 such that the position of the mounting base 164 is adjustable by loosening and moving the base 164 relative to the frame 116. Thus, the position of the drive mechanism of the platen roller 93 on the frame 116 of the printer 80 is optimized.

Figure 15:
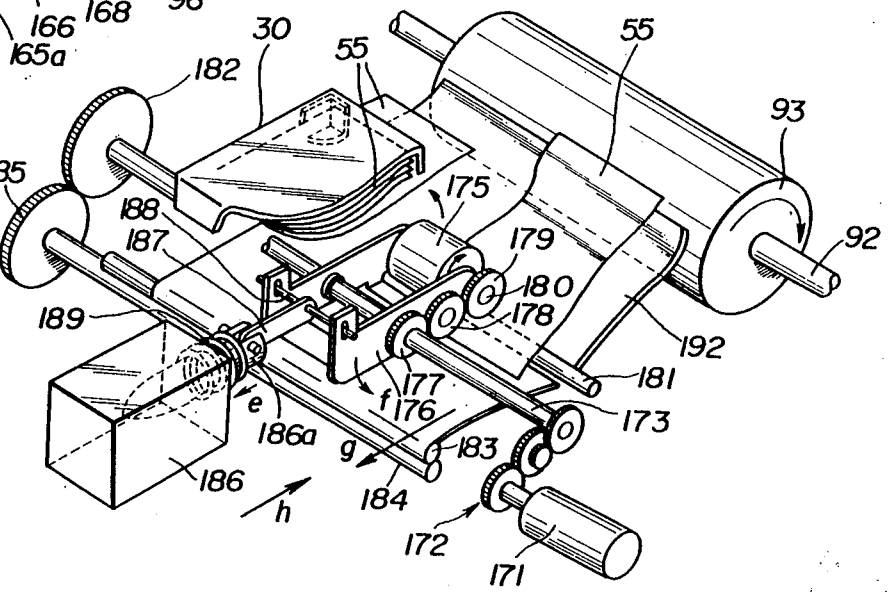
FIG. 15 is a perspective view showing a mechanism for feeding and discharging paper on and from the platen roller of FIG. 14.
Figure 16:
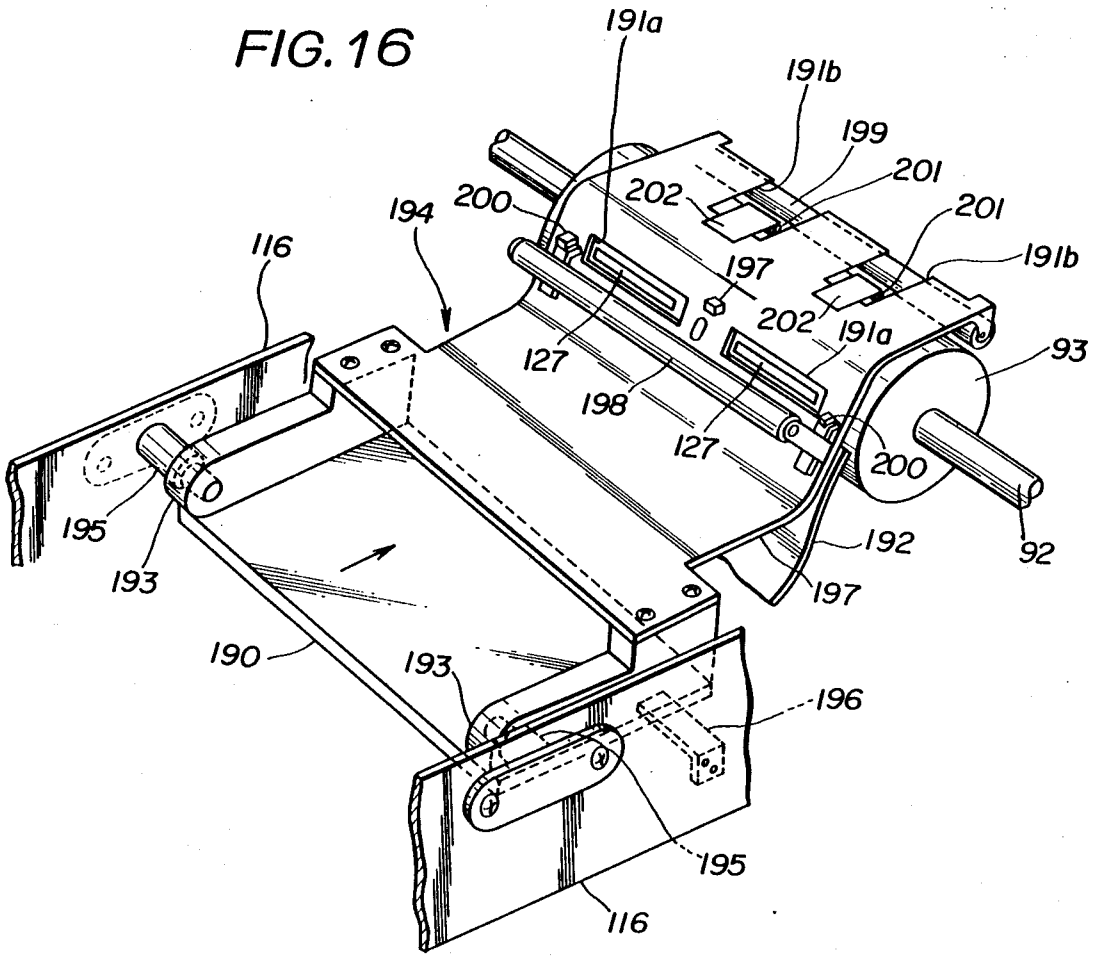
FIG. 16 is a perspective view showing a guide mechanism for guiding the recording paper.

Next, a mechanism for feeding the paper on the platen roller and for discharging the paper from the platen roller will be described with reference to FIGS. 15 and 16. Referring to FIG. 15, a feed roller 175 is supported rotatably on a shaft 180 which is held in a frame 176 which in turn is held rotatably around the drive shaft 173. The feed roller 175 is driven by the motor 171 via the reduction gear system 172, the shaft 173 engaged with the gear system 172, and gears 177, 178 and 179. It should be noted that a gear 182 is fixed on the end of the shaft 173, and the gear 182 is meshed with a gear 185 for driving a discharge roller 184. When the feeding of recording paper is not performed, the feed roller 179 is engaged with a discharge roller 181 located below the feed roller 175 by its weight. Further, a roller 183 is provided above the discharge roller 184 such that the roller 183 is engaged with the discharge roller 184 by gravity.

Figure 26:
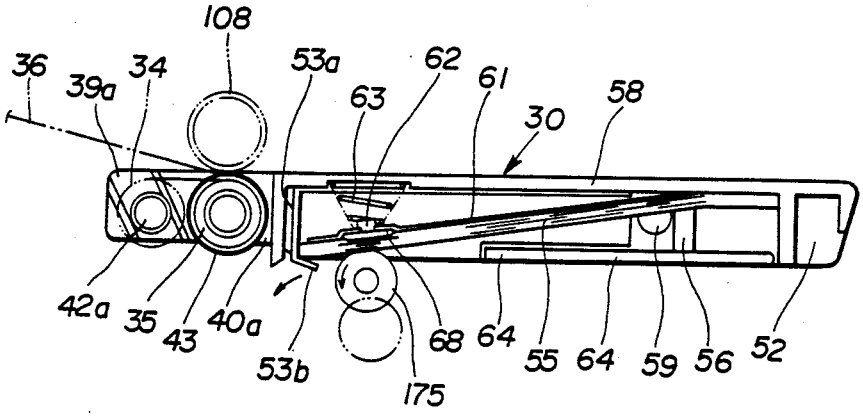
FIG. 26 is a side view of the cartridge showing operation for feeding a paper.

When feeding a paper on the platen roller 93 by driving the feed roller 175, an actuator rod 186*a* of a solenoid actuator is moved in the direction indicated in FIG. 15 by an arrow d. Responsive to this movement of the rod 186*a*, a shaft 188 is pulled by a link 187 connected to the rod 186*a*, the frame 176 is rotated in the counter clockwise direction indicated by an arrow e, and the feed roller 175 is engaged with the paper 55 in the stack of recording papers held in the cartridge 30 located above the feed roller 175 as shown in FIG. 26. When the motor 171 is driven in this state, the feed roller 175 driven via the gears 177 and 178 makes contact with a paper located at the bottom of the stack and draws out the paper from the cartridge 30 as indicated by an arrow in FIG. 26. This paper is then transported to the platen roller 93 by the feed roller 175. Further, the solenoid actuator 186 carries a spring 189 for returning the actuation rod 186*a* to its original position.

When discharging paper from the platen roller 93, the solenoid actuator 186 is not energized and the motor 171 is driven in a same direction as the direction of driving at the time when feeding the paper. As a result, the paper 55 is transported in the direction indicated by an arrow g in FIG. 15. Thus, the feed roller 175 is used not only for feeding the paper but also for discharging the paper and the mechanism for feeding the paper is simplified.

Further, when supplying the paper manually one by one on the platen roller 93 in such an occasion that the cartridge is empty, the motor 171 is reversed without actuating the solenoid actuator 186. With this operation, the paper is transported along a path of the paper at the time of discharging the paper with reversed direction to the platen roller 93. Thus, the mechanism is simple and the printer can be constructed compactly as a result.

Next, the transportation of the paper at the time of feeding will be described with reference to FIG. 16. The paper 55 drawn out from the cartridge 30 against the action of the fingers 53*b* for holding the paper inside the cartridge is transported along a path which passes between a pair of guide plates 190 and 191 of a guide assembly 194 connected to each other by a link 193, and is guided along another guide plate 192 until it reaches the clamper 127 of the platen roller 93 which is opened so as to accept the paper between the clamping portion of the clamper 127 and the platen roller 93. The guide assembly 194 is held rotatably on a shaft 195 provided on the frame 116 of the printer, and positioned by abutting with a stopper 196.

The front end of the guide plate 191 is extended so as to cover more or less the platen roller 94 and the guide plate 191 is formed with a pair of elongated openings 191*a* provided so as to allow movement of the clamper 127 of the platen roller 93 in the radially outward direction from the platen roller 93. Further, the guide plate 191 carries a photo sensor 197 for detecting when the recording paper 55 is securely held on the platen roller 93 by the clamper 127 or not. Further, the guide plate 191 carries guide rollers 198 and 199 for guiding the ink film 36 and a photo detector 200 for detecting a mark on the film 36 indicating the position for starting printing or position of the ink provided on the film 36. Furthermore, the front end of the guide plate 191 is formed with a pair of cutouts 191*b*, and in these cutouts, a roller 201 carried on a leaf spring 202 for pressing the paper on the platen roller 93 is provided.

Next, operation of the printer 80 from the loading of the cartridge 30 to the feeding and discharging of the paper will be described. Referring to FIG. 12, the cartridge 30 is inserted into the printer 80 through the insertion opening 81 such that the side of the cartridge 30 from which the recording paper is taken out is oriented downwards. The cartridge 30 is guided in the printer 80 by the guide grooves 91*a* and 91*b* shown in FIG. 11 and reaches the fully loaded state in which the rear end of the cartridge 30 defines a flush surface with the front panel 82 of the printer 80. In this state, the core 37 of the take up roll 34 is engaged with the arms 96*a* and 96*b* and the slope 50*b* at the front end of the rib 50 actuates the switch SW1. Responsive to the actuation of the switch SW1, the motor 99 and the solenoid actuator 145 shown in FIGS. 18 and FIGS. 19(A) and (B) are energized and the thermal head 143 is moved away from the platen roller 93 as shown in FIG. 22. Further, responsive to the rotation of the motor 99, the arms 96*a* and 96*b* carry the take up roll 34 and transport them away from the cartridge 30 as shown in FIG. 22. When the arms are fully rotated, the pin 98 carried by the arm 96*a* actuates the switch SW3 and the motor 99 is deenergized.

At the same time as the deenergizing of the motor 99, the solenoid actuator 145 is also deenergized and then the pair of coupling members 139 are engaged with the core 37 of the take up roll 34. Further, the drive shaft 138 is driven by the motor 132 and the ink film 36 engaging with the platen roller 93 is drawn out until the film 36 reaches a predetermined position ready for printing. The position of the film 36 on the platen roller 93 is detected by the photo detector 200 which detects the reflection of light from a predetermined marking on the film 36 such as the first inked part having the first color (yellow, for example) of the sequence of inked parts on the film 36, and responsive to the detection, the motor 132 is deenergized. With the preparatory operation as described, the printer 80 becomes ready for printing. It should be noted that, during this initial draw out of the film 36, the supply roll 35 is applied with a suitable back tension by the urging force of the spring 47 (FIG. 7) urging the gear 43, and the excessive unwinding of the roll 35 which eventually leads to the creasing of the ink film 36 is prevented.

When the loading of the ink film 36 is completed, the thermal head 143, which has been in the position moved away from the platen roller 93 as shown in FIG. 22 during the loading of the ink film 36, is moved towards the platen roller 93 as shown in FIG. 23.

In this state shown in FIG. 23, the feeding of the recording paper 55 is started responsive to the actuation of a start button (not shown) on the printer 80 commanding the start of printing. Thus, responsive to the actuation of the start button, the solenoid actuator 121 of the ink film take up mechanism 107 is actuated and the clamper 127 is released. Further, the feed roller 175 is displaced upwards by the operation of the solenoid actuator 186 shown in FIG. 15 and is resiliently engaged with the recording paper 55 in the paper stack in the cartridge 30 as a result of the urging force of the conically configured spring 63 (see FIG. 2(C)) in the cartridge 30. Further, the motor 171 is energized and the paper in the lower most position in the stack of papers in the cartridge 30 is fed towards the platen roller 93. More specifically, the paper 55 is deformed as a result of the friction engagement with the feed roller 175 and is disengaged from the fingers **53*b* and 54*b* holding the paper in the recording paper accommodating part 33 of the cartridge 30. The paper 55 thus separated from the cartridge 30 is transported with the rotation of the feed roller 175 and is fed on the platen roller 93 until it is engaged with the clamper 127 shown in FIG. 21**.

When the photo sensor 197 detects the recording paper 55 on the platen roller 93, the solenoid actuators 121, 186 and the motor 171 shown in FIGS. 13 and 15 are deenergized. Responsive to the deenergizing of the solenoid 121, the clamper 127 holds the paper 55 on the platen roller 93 securely. As already described, the inner surface of the clamping portion of the clamper is provided with knurling and the like for increasing the frictional engagement, the clamper 127 securely holds the paper on the platen roller 93.

After the paper 55 is held securely on the platen roller 93, the motor 116 shown in FIG. 14 is energized and the platen roller 93 is rotated. As the same time, the photo detecting mechanism 170 produces output pulses indicating the rotation of the platen roller 93. Thus, when the clamper 127 on the platen roller 93 passes under the thermal head 143 as a result of rotation of the platen roller 93, the solenoid actuator 159 is energized and the thermal head 143 is moved towards the platen roller 93 from the state shown in FIG. 22 to the state shown in FIG. 23, and the ink film 36 is pressed on the paper 55 held on the platen roller 93. At the same time, the motor 132 for driving the core 37 of the take up reel 34 is energized and the ink film 36 is wound on the take up roll 34 until it is discriminated as a result of the output signal of the photo detector 200 that the ink film 36 has reached the predetermined position ready for printing.

When the ink film 36 is moved to the predetermined position ready for printing, the thermal head 143 is supplied with a current corresponding to the image to be printed, and the ink on the film 36 is transferred to the recording paper 55 while rotating the platen roller 93 and feeding the ink film at the same time in synchronization with the rotation of the platen roller 93 and thus the printing of the image on the recording paper is achieved. During this printing operation, the roller 201 continuously urges the paper on the platen roller 93, and the paper is securely held on the platen roller 93. Thus, a high quality of printing can be made with excellent precision.

After the printing of the image in the first color such as yellow is completed, the solenoid actuator 159 is deenergized when the clamper 127 comes close to the thermal head 143 with the rotation of the platen roller 93. Thus, the thermal head 143 is removed from the surface of the platen roller 93 by the force exerted by the spring 161 as shown in FIG. 23, and the solenoid actuator 159 is again energized and the thermal head 143 is again pressed on the surface of the ink film 36 on the platen roller 93. During this interval in which the thermal head 143 is moved away from the surface of the platen roller 93, the ink film 36 is fed further until it is discriminated on the basis of the output signal from the photo detector 200 that the second marking or the second linked part on the film 36 has reached the predetermined position ready for printing relative to the recording paper 55 on the platen roller 93. Similarly, this printing procedure is repeated and a desired color printing is completed. The control of the thermal head 143, the position of the ink film, and the timing by which the head is removed from the platen roller 93 are made on the basis of the pulse generated from the motor 165.

After the printing is completed, the recording paper 55 thus printed is discharged from the printer 80 by reversing the platen roller 93 in the counter clockwise direction when the rear end of the paper 55 has reached the position at which the front end of the paper 55 is clamped on the clamper 127 at the time of feeding. During this reversal in the rotation of the platen roller 93 for discharging the paper, the discharge rollers 181, 183 and 184 in FIG. 15 are driven. Further, when the recording paper 55 on the platen roller 93 has reached the aforementioned position in which the rear end of the paper coincides with the position at which the paper is held on the platen roller at the time of feeding, the solenoid actuator 121 is energized and the clamper 127 is released. Further, the rotation of the platen roller 93 is stopped at the same time.

Responsive to the reversed rotation of the platen roller 93 in the counter clockwise direction in FIG. 15, the paper 55 is disengaged from the platen roller 93 and is accepted on the guide plate 192. The paper 192 is then transported along the guide plate 192 by gravity and is held between the feed roller 175 and the discharge rollers 183 and 184. Further, the motor 171 is energized and the feed roller 175 and the discharge rollers 183 and 184 are driven as a result of the rotation of the motor 171. Thus, the paper 55 is driven by the feed roller 175 as well as by the discharge rollers 183 and 184 and is fed between guide plates 203 and 204 following the discharge rollers 183 and 184. Further, the motor 171 and the solenoid actuator 121 are deenergized when a sensor 205 detects the paper 55. Thus, the paper is held between the guide plates 204 and 205 when the discharge of the paper is completed and the discharged paper is prevented from falling on the floor. Further, the platen roller 93 is rotated to the initial position in which the clamper 127 is positioned so as to accept the feeding of the next paper. This return of the platen roller 93 to the initial position is discriminated by the disk-shaped sensor plate 163 and the photo detecting mechanism 170. Further, the motor 132 is rotated again for further drawing out the ink film 36 to the position ready for printing, and the printer 80 becomes ready for printing for the next sheet of paper. Thus, responsive to the re-operation of the start button of the printer 80, the printing on the next paper is commenced.

When the ink film 36 is used up and wound up on the take up roll 34, the ink film 36 has to be replaced with a new one. In order to replace the ink film 36, an unloading button of the printer (not shown) is operated by the user, and responsive thereto, the arms 96*a* and 96*b* are rotated in the counter clockwise direction in FIG. 11 or in the clockwise direction in FIG. 22. Thus, the take up roll 34 held in the U-shaped openings $96a_1$ and $96b_1$ at the end of the arms 96*a* and 96*b* is returned to the ink roll roll holding part 32 of the cartridge 30. A same operation is performed also when the printer has detected that the ink film is used up. During the movement of the arms 96*a* and 96*b* to the state shown in FIG. 22 by the solid line, the solenoid actuator 121 in FIG. 13 is energized and the slidable gear 113 is connected to the motor 99 driving the arms 96*a* and 96*b*. As a result, the film 36 is taken up on the supply roll 35 with the arms 96*a* and 96*b* moving back to the state shown in FIG. 22. When the arms 96*a* and 96*b* are fully returned, the pin 98 on the arm 96*a* actuates the switch SW2 and the motor 99 is deenergized responsive thereto.

In the state, the cartridge 30 is ready for pulling out from the printer 80, and by removing the cartridge 30 from the printer 80, the user can perform the replacement of the ink film roll 35. During this operation, the user can check the consumption of the paper in the cartridge 30, and can supply the paper in the cartridge 30 is necessary.

In the description heretofore, the take up roll 34 is transported by the levers 96*a* and 96*b*. However, the present invention is not limited to such an embodiment but may be constructed such that the supply roll 35 is transported by the levers. In this case, however, it is necessary to modify the disposition of the gear 43 as the take up roll 34 is held in the cartridge 30 in this modification.

Figure 27A:
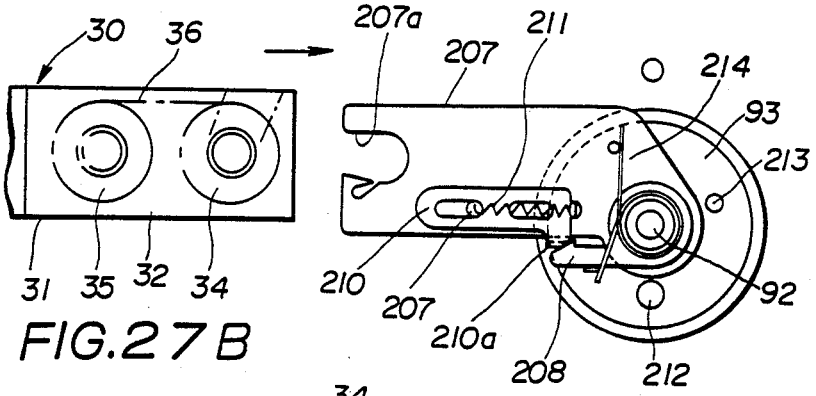
FIGS. 27(A) through (D) are side views showing modifications of the mechanism for driving the take-up roll.
Figure 27B:
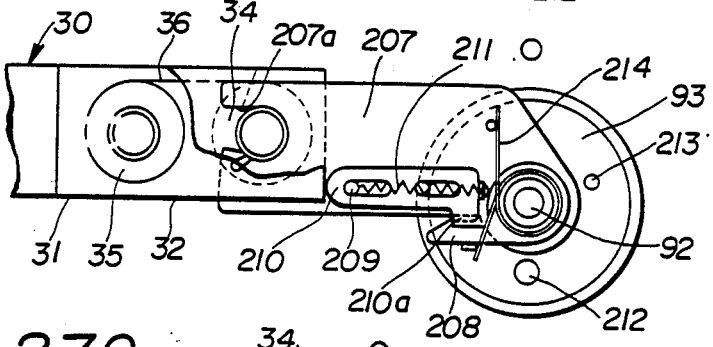
Figure 27C:
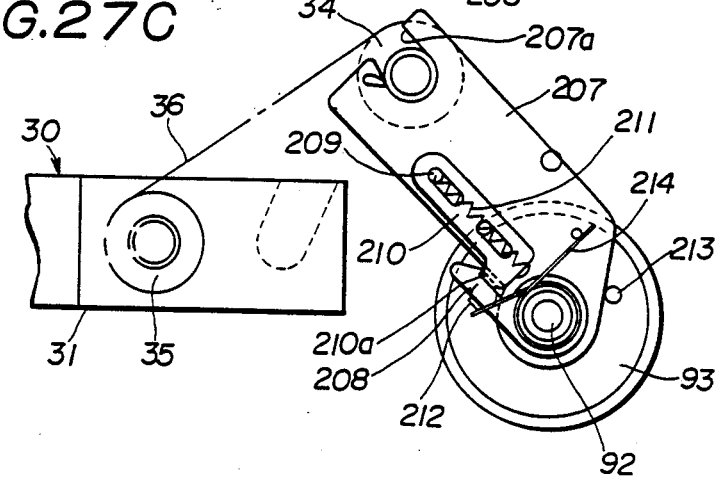
Figure 27D:
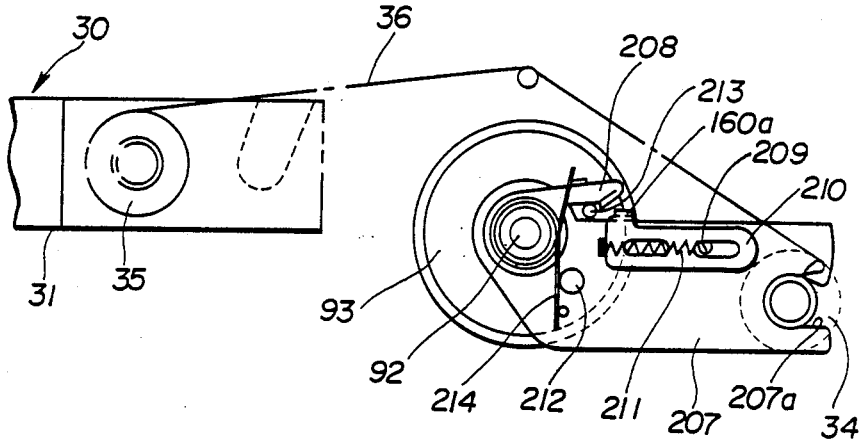

Next, another embodiment of the printer of will be described with reference to FIGS. 27(A)–(D) in which the platen roller is rotated in synchronization with the movement of the arms. In this embodiment, one can eliminate the use of a separate motor for driving the arms. Referring to the drawings, an arm 207 corresponding to the arm 96*b* of FIG. 22 carries a slide member 210 slidably held on a pin 209 and held rotatable about the shaft 92 of the platen roller 93 relative to the platen roller similarly to the previous embodiment. Further, the shaft 92 carries a hook 208 which can be displaced relative to the arm 207. Thus, when the cartridge 30 is inserted into the printer 80 in the state shown in FIG. 27(A), the take up roll 34 is engaged into an opening 207*a* at the end of the arm 207 held horizontally for accepting the take up roll 34, and at the same time, the slide member 210 is displaced towards the shaft 92 by the front end of the cartridge 30 against the force exerted by a spring 211, and the hook 208 is locked with the slide member 210. When the platen roller 93 is rotated about the shaft 92 in this state in the clockwise direction, a pin 212 at the side of the platen roller 93 is engaged with a bent portion 210*a* of the slide member 210 as shown in FIG. 27(C), and the arm 207 is moved with the platen roller 93 towards the clockwise direction. Thus, the take up roll 34 is transported to the predetermined position shown in FIG. 27(D). Immediately before reaching the state shown in FIG. 27(D), a pin 213 provided on the printer 80 holds the hook 208. Thus, with the further rotation of the platen roller 94 in the clockwise direction, the hook 208 is rotated relative to the platen roller 93 in the counter clockwise direction. As a result, the slide member 210 is disengaged from the hook 208 and is returned to the original position in the arm 207. Thereafter, the engagement of the pin 212 with the slide member 210 is cancelled and the platen roller 93 can rotate freely relative to the arm 207 for printing. When returning the arm 207, a unidirectional clutch (not shown) between the shaft 92 and the arm 207 is engaged, and the arm 207 is moved responsive to the clockwise rotation of the platen roller 93 and the take up roll 34 is returned to the ink roll holding part 32 of the cartridge 30. In this embodiment, the arm 207 is moved responsive to the rotation of the platen roller 93, and use of a separate motor for driving the arm can be eliminated. This leads to the reduction in size as well as in cost of the printer.

Figure 28:
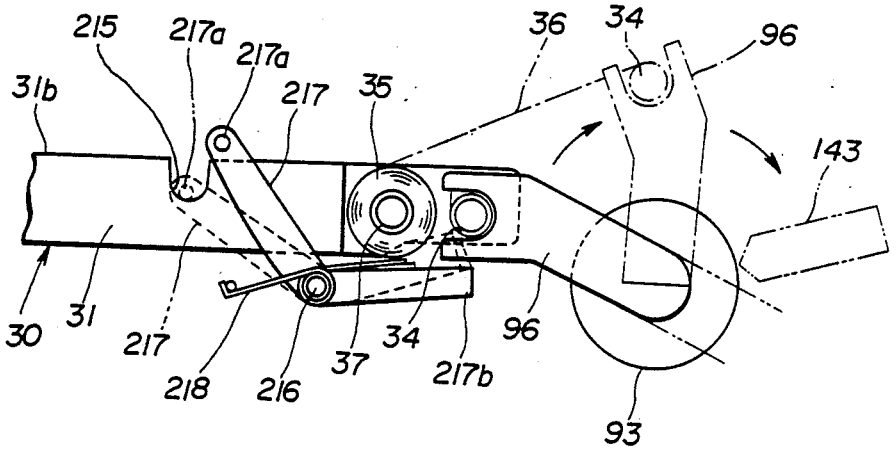
FIG. 28 is a side view showing a locking mechanism of the cartridge.

FIG. 28 shows a locking mechanism of the cartridge 30. Referring to the drawing, the top side 31*b* (see FIG. 2(C)) of the cartridge body 31 if formed with a cutout 215. Further, a bent locker arm 217 is supported rotatably on a shaft 216 fixed on the body of the printer 80, and a portion spring 218 is fitted on the shaft 216. The portion spring 218 has an end fixed to the body of the printer 80 and another end connected to an end of the locker arm 217 so as to urge the locker arm 217 in the counter clockwise direction. As rotation of the locker arm 217 is restricted by abutting with the arm 96*a* or 96*b* when the arms 96*a* and 96*b* are is in the state shown in FIG. 28, the arm 217 is held at the position shown by the solid line in FIG. 28. When the cartridge 30 is inserted into the printer 80 as shown in FIG. 11, the core 37 of the take up roll 34 at the front end of the cartridge 30 is engaged into the U-shaped opening at the end of the arm 96*b*. Further, when the arm 96 is rotated from this state in the clockwise direction so as to transport the take up roll 34 over the platen roller 93, the restriction preventing the locker arm 217 from rotating in the counter clockwise direction is removed and the locker arm 217 is rotated in the counter clockwise direction by the force exerted by the portion spring 218. As a result of this rotation of the locker arm 217, a pin 217*a* formed at the end of the arm 217 is accepted in the cutout 215 on the top side 31*b* of the cartridge 30. Thus, the cartridge 30 is locked in the printer 80 by the pin 217*a* at the end of the locker arm 217.

Figure 29:
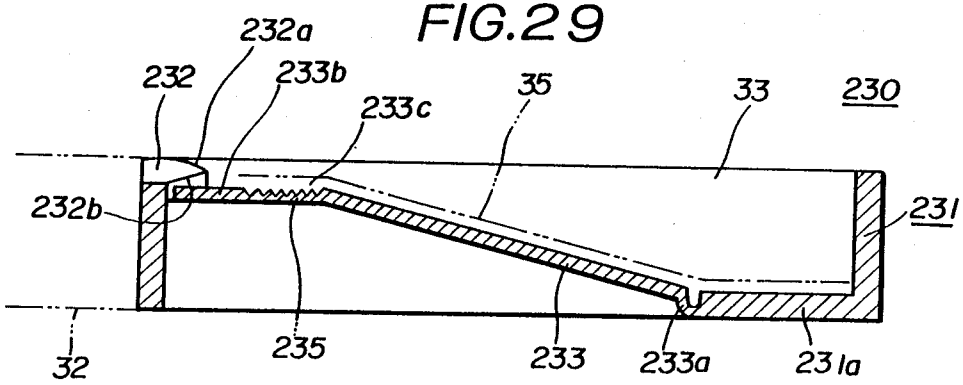
FIG. 29 is a cross sectional view showing a modification of the cartridge.

Next, a cheaply constructed disposable type cartridge 230 which is a modification of the cartridge 30 will be described with reference to FIG. 29. Referring to the drawing, the disposable type cartridge 230 comprises a cartridge body 231 moulded from a polypropylene based resin on which a finger 232 corresponding to the fingers 53*b* and 54*b* and a movable tray 233 corresponding to the movable tray 61 of the cartridge 30 are provided unitarily. The cartridge 230 has the recording paper accommodating part 33 and the movable tray 233 is accommodated in the part 33 such that the tray 233 is connected to a bottom side 231*a* of the cartridge body 231 via a flexible part 233*a* such that the tray 233 can move up and down about the flexible part 233*a*. It should be noted that the free end of the movable tray 233 is located adjacent to the finger 232. The free end of the tray 233 is formed with a flat part 233*b* which is horizontal in the state shown in FIG. 29. On the side of the flat part 233 facing the feed roller 175 shown in FIG. 15 there is formed a creased part 233*c* along a direction perpendicular to the feeding direction of the paper. As can be seen from FIG. 29, the finger 232 having a rounded surface 232*a* on the side facing the feed roller and has a tapered surface 232*b* projects towards the stack of papers (not shown) held on the movable tray 233. Thus, the separation of the individual sheet of paper from the paper stack in the cartridge 30 is facilitated. It should be noted that the cartridge 230 is inserted into the printer 80 similarly to the cartridge 30 such that the ink roll holding part 32 indicated by a two-dotted line in FIG. 29 is inserted first into the printer 80. Further, a hole 235 for detecting the recording paper is formed on the flat part 233*b* so as to enable the detection of the paper in the recording paper accommodating part 33 by means of a photo sensor detecting the reflection of light from the paper in the recording paper accommodating part 33. Such a cartridge 230 moulded from a resin as an integral body can also be used as a cartridge for other type of printer which uses a cartridge carrying a roll of ink ribbon. Further, the cartridge 230 can be used as a simple tray for holding the recording paper alone.

Figure 30:
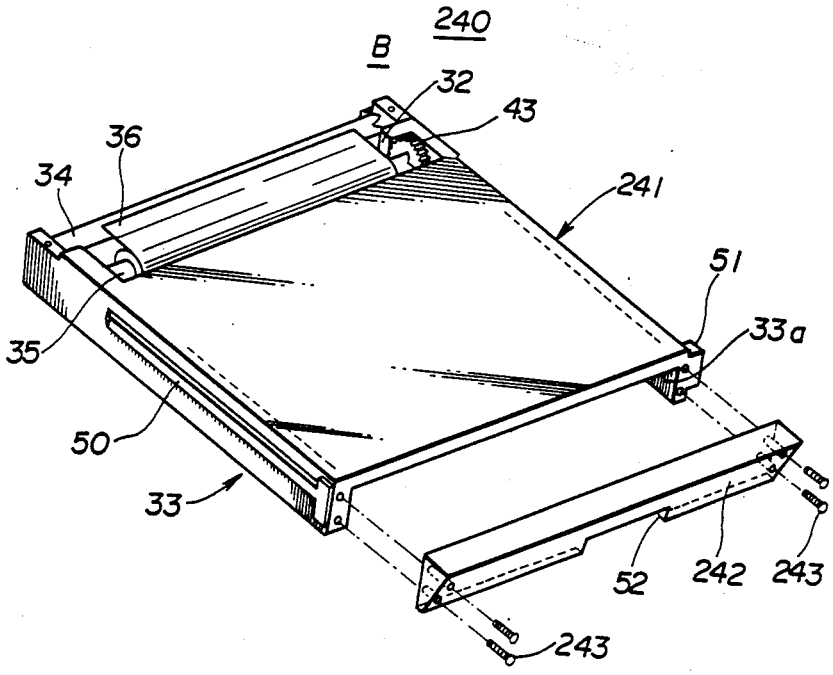
FIG. 30 is a perspective view showing another modification of the cartridge.

FIG. 30 shows a modification of the cartridge. Referring to FIG. 30, the cartridge 240 has a substantially identical construction to the cartridge 30 shown in FIGS. 2(A)-(C) except that the rear end 242 of the cartridge 240 is made of a transparent material. The transparent rear end 242 may be mounted on a cartridge body 241 having a similar construction as the cartridge body 31 except that the rear end is removal, and the rear end 242 is mounted on the cartridge body 241 by screws 243. According to this modification, the user can check the amount of paper remaining in the cartridge 240 visually through the rear end.

Figures 31A, 31B:
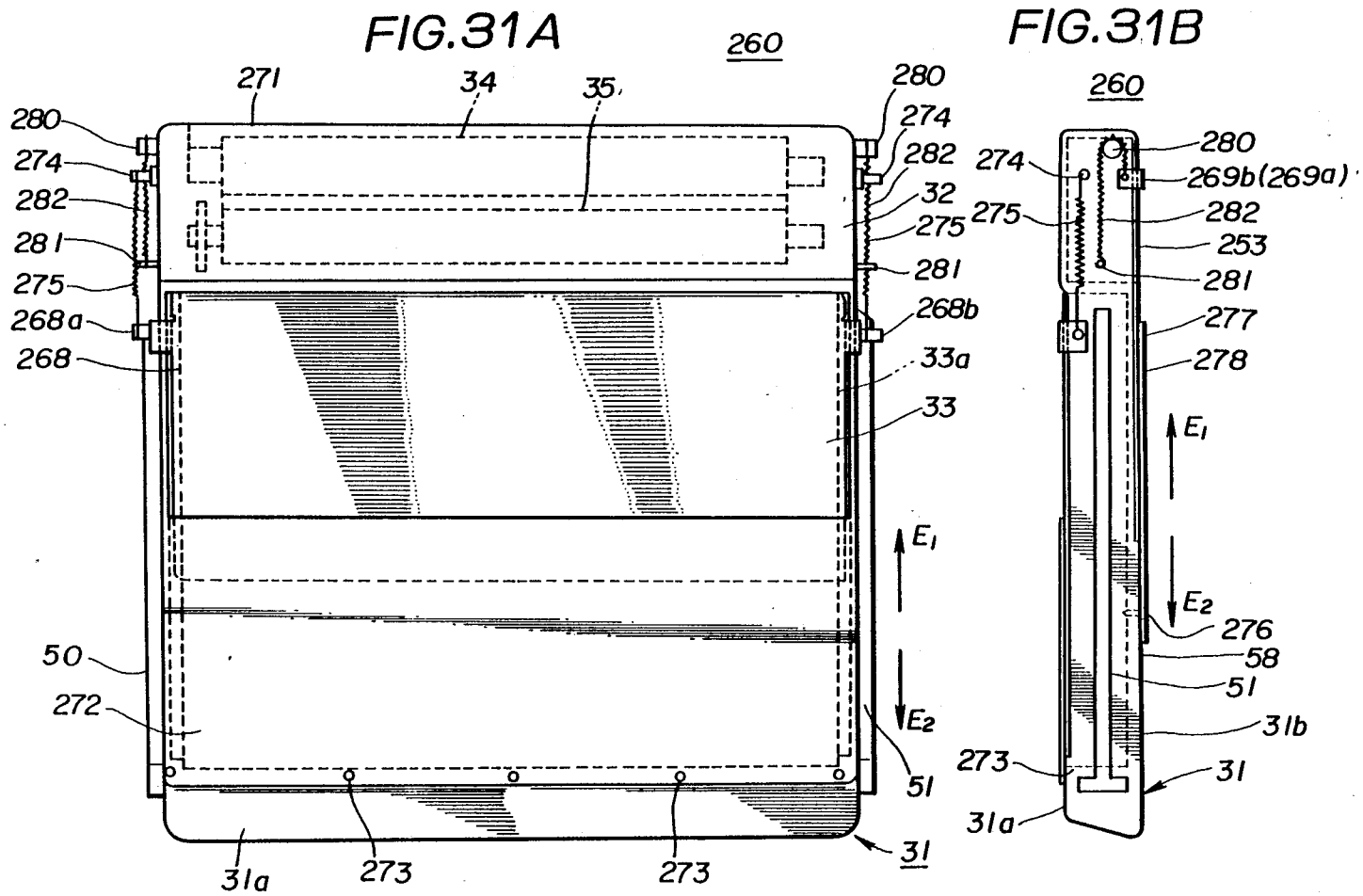
FIGS. 31(A) and (B) are respectively a bottom view and a side view showing yet another modification of the cartridge before loading into the thermal imprint recording apparatus.
Figures 32A, 32B:
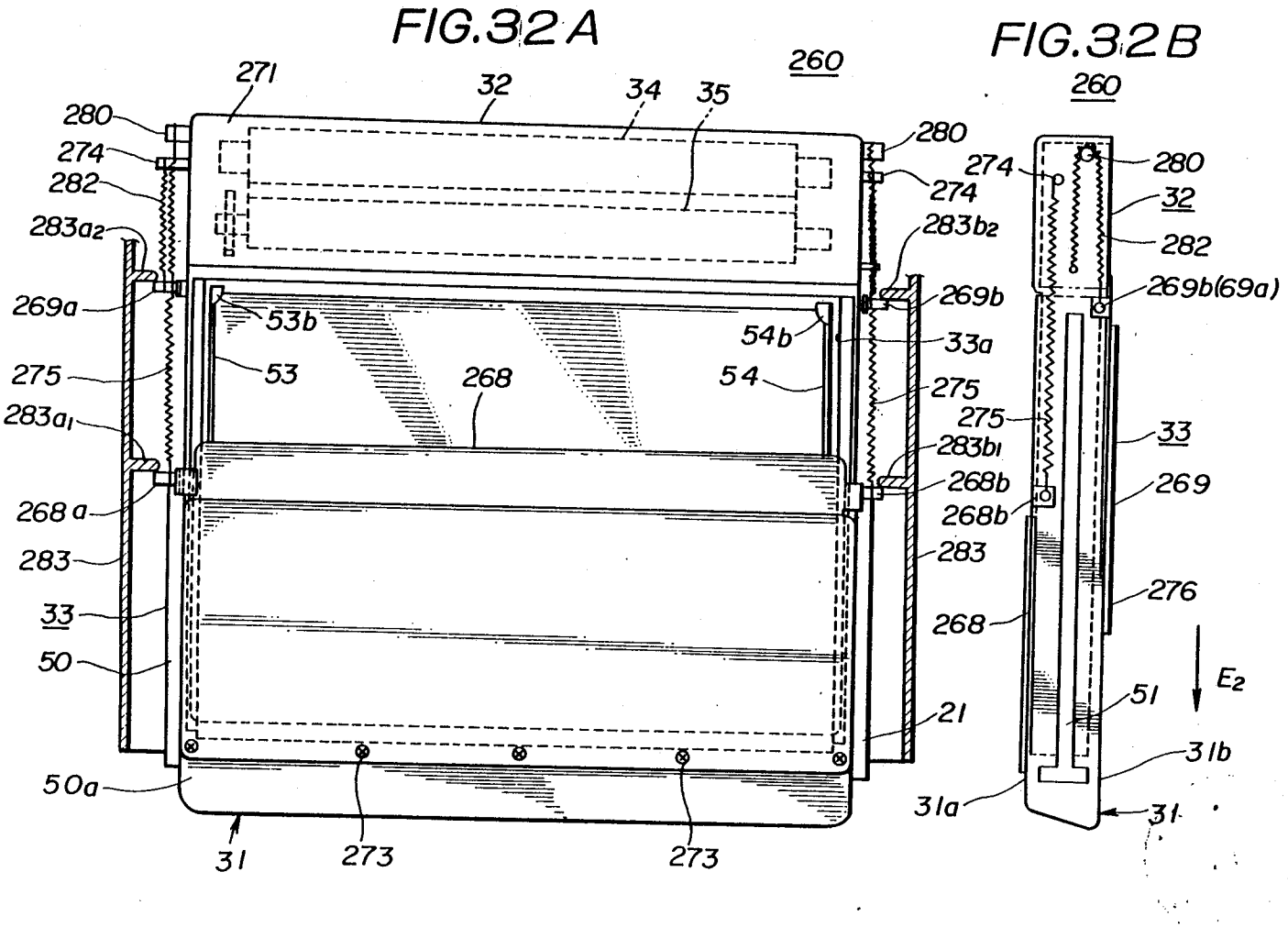
FIGS. 32(A) and (B) are a bottom view and a side view of the cartridge shown in FIGS. 31(A) and (B) in an operational state.

Next, another modification of the cartridge applicable to the printer 80 will be described with reference to FIGS. 31(A) and (B) as well as FIGS. 32(A) and (B). Referring to FIGS. 31(A) and (B), the cartridge has a generally identical construction to the cartridge 30 shown in FIG. 2(A) except that the overall construction is enclosed by a cover 268 which is movable along the bottom side 31*a* of the cartridge body 31 in the directions shown by arrows $E_1$ and $E_2$ so as to close the opening 33*a* in the recording paper accommodating part 33 and another cover 269 which is movable along the top side 31*b* of the cartridge body 31 in the directions $E_1$ and $E_2$ so that the ink roll holding part 32 is covered by the cover 269. Further, the top plate 58 (FIG. 31(B)) closes the top side 30*b* of the cartridge 30 and the entire structure of the cartridge 30 is closed.

Further, the cartridge body 31 is fixed with a guide plate 272 similar to the lid 64 so as to close the bottom side 31*a* of the cartridge body 31 at the side close to its rear end by screws 273 as shown in FIG. 31(B). Thus, the cover 268 is held in a groove 279 defined between the guide plate 272 and the cartridge body 31 and is guided in the direction indicated by the arrows $E_1$ and $E_2$. Further, the cover 268 carries a pair of projections 268*a* and 268*b*, and a pair of springs 275 having respective ends fixed to the cartridge body 31 by a pin 274 are connected to these projections so as to urge the cover 268 towards the direction $E_1$. As a result, the opening 33*a* is closed by the cover 268 in the normal state in which the cartridge is not inserted into the printer 80. Thus, intrusion of dust into the cartridge is prevented and the recording paper in the cartridge is prevented from becoming stained.

Similarly, the cover 269 closing the ink roll holding part 22 of the cartridge is held slidably in a groove 278 defined between the top side 31*b* of the cartridge body 31 and the guide plate 277 fixed thereto by screws 276 (FIG. 31(B)) in the directions $E_1$ and $E_2$. Further, the cover 269 carries a pair of projections 269*a* and 269*b* extending laterally from the cover 269, and a pair of springs 282 having respective ends fixed to the cartridge body 31 by a pin 281 is connected to the projections 269*a* and 269*b* after being turned around a pin 280 formed on the cartridge body 31. As a result, the cover 269 is urged in the direction $E_1$ in the normal state and the ink roll holding part of the cartridge is closed by the cover 269.

When the cartridge 260 having the construction thus described is inserted into the printer 80 through the insertion opening 81 in the direction $D_1$ as indicated in FIG. 12 such that the ink roll holding part 32 is inserted first into the printer 80, the projections 268*a* and 268*b* on the cover 268 is held by projections $283a_1$ and $283b_1$ of a stopper 283 provided in the printer 80, and the cover 268 is displaced relatively to the cartridge 260 in the direction $E_2$ and the opening 33*a* is exposed. Further, responsive to the insertion of the cartridge 260 into the printer 80, the projections 269*a* and 269*b* of the cover 269 are held by projections $283a_2$ and $283b_2$ of the stopper 283, and the cover 269 is displaced in the direction $E_2$ relative to the cartridge 260 and the ink roll holding part 32 is exposed. Further, at the same time as the displacement of the covers 268 and 269, the take up roll 34 and the arms 96*a* and 96*b* are engaged, and the feed roller 175 is moved into the cartridge 260 through the opening 33*a*. Thus, the printer 80 becomes ready for printing.

Further, various variations and modifications may be made without departing from the scope of the present invention.

What is claimed is:

1. A thermal imprint recording apparatus adapted to be mounted with a paper cartridge accommodating a paper for recording an image on the paper fed from a first side of the paper cartridge by a thermal head via an ink film supplied from a first roll of ink film held on the paper cartridge after the ink film is drawn out through a second side of the cartridge opposite to said first side, said cartridge carrying a second roll of the ink film on which the ink film is taken up adjacent to the first roll, comprising:

a platen roller on which the paper is fed from the cartridge;

thermal head means including the thermal head disposed so as to be pressed on a surface of the platen roller for recording the image on the paper fed on the platen roller;

an insertion opening formed on a front panel of the apparatus for accepting the cartridge when the cartridge is mounted on the apparatus;

a discharge opening provided on the front panel of the apparatus for discharging the paper after the image is recorded by the thermal head;

a cartridge accommodating space defined in the printer for accepting the cartridge when the cartridge is inserted into the printer;

ink film loading means comprising an arm driven by a driving means and movable between a first state for engaging with one of said first and second ink film rolls held on the cartridge and a second state for drawing out the ink film from the other of the ink film rolls held on the cartridge so as to draw out the ink film and load the ink film at a predetermined position between the platen roller and the thermal head means;

paper feed means disposed in the cartridge accommodating space so as to be located at a side of the cartridge opposite from the side from which the ink film is drawn out when the cartridge is inserted into the printer for feeding a sheet of paper in the cartridge one by one; and discharge means disposed on a same side as the paper feed means relative to the cartridge in the cartridge accommodating space in a state generally parallel to the cartridge when the cartridge is inserted in the printer, for transporting the paper subjected to the recording from the platen roller to said discharge opening.

2. A thermal imprint recording apparatus as claimed in claim 1 in which said ink film loading means is disposed above the paper cartridge in the cartridge accommodating space when the paper cartridge is inserted into the apparatus and draws out the ink film from the upper side of the paper cartridge responsive to the movement of the arm, and said paper feed means is located below the paper cartridge in the cartridge accommodating space when the paper cartridge is inserted into the apparatus and feeds the paper from the lower side of the paper cartridge.

3. A thermal imprint recording apparatus as claimed in claim 2 in which said discharge means comprises a discharge roller and is disposed further below the paper feed means.

4. A thermal imprint recording apparatus as claimed in claim 3 in which said paper feed means comprises a feed roller disposed between the paper in the paper cartridge and the discharge roller and is driven in a direction so as to feed the paper from the paper cartridge to the platen roller, and a feed roller moving means for moving the feed roller upwards and downwards so that the feed roller is urged on the paper in the paper cartridge when feeding the paper to the platen roller and so that the feed roller is urged on to said discharge roller when discharging the paper from the platen roller.

5. A thermal imprint recording apparatus as claimed in claim 1 in which said loading means loads the ink film so that the face of the ink film carrying the ink faces the platen roller.

6. A thermal imprint recording apparatus as claimed in claim 1 further comprising detection means for detecting that the cartridge is fully inserted into the cartridge accommodating space, and said detection means produces an output signal responsive to which the operation of the ink film loading means is triggered.

* * * * *